US008353402B2

(12) United States Patent
Apps

(10) Patent No.: US 8,353,402 B2
(45) Date of Patent: Jan. 15, 2013

(54) STACKABLE LOW DEPTH TRAY

(75) Inventor: William P. Apps, Alpharetta, GA (US)

(73) Assignee: Rehrig Pacific Company, Los Angeles, CA (US)

( * ) Notice: Subject to any disclaimer, the term of this patent is extended or adjusted under 35 U.S.C. 154(b) by 372 days.

(21) Appl. No.: 12/573,414

(22) Filed: Oct. 5, 2009

(65) Prior Publication Data

US 2010/0084302 A1 Apr. 8, 2010

Related U.S. Application Data

(60) Provisional application No. 61/102,965, filed on Oct. 6, 2008.

(51) Int. Cl.
*B65D 21/032* (2006.01)
*B65D 1/36* (2006.01)
*B65D 25/04* (2006.01)

(52) U.S. Cl. ..... 206/505; 206/561; 220/509; 220/555

(58) Field of Classification Search ..... 220/515, 220/509, 507, 555, 553, DIG. 2; 206/505, 206/518; *B65D 21/032, 25/04, 1/36, 1/34*
See application file for complete search history.

(56) References Cited

U.S. PATENT DOCUMENTS

| | | | |
|---|---|---|---|
| 820,445 | A | 5/1906 | Speer |
| D103,862 | S | 3/1937 | Randall et al. |
| 2,411,673 | A | 11/1946 | Vechey, Jr. |
| D147,981 | S | 11/1947 | Lehman |
| D152,907 | S | 3/1949 | Richards |
| 2,588,805 | A | 3/1950 | Cross |
| 2,512,855 | A | 6/1950 | Erickson |
| 2,530,481 | A | 11/1950 | Rawn, Jr. |
| 2,526,335 | A | 12/1950 | Diechert |
| 2,535,493 | A | 12/1950 | Gerber |
| 2,626,079 | A | 1/1953 | Keller |
| D172,664 | S | 7/1954 | Emery |
| 2,743,030 | A | 4/1956 | Read, Jr. |
| 2,840,256 | A | 6/1958 | Cobb, Jr. |
| 2,928,530 | A | 3/1960 | Sauey |
| 2,935,222 | A | 5/1960 | O'Connell |
| 2,970,715 | A | 2/1961 | Kappel et al. |
| D189,891 | S | 3/1961 | Schilling et al. |
| 2,974,819 | A | 3/1961 | Melville |

(Continued)

FOREIGN PATENT DOCUMENTS

| | | |
|---|---|---|
| BE | 680197 | 10/1966 |

(Continued)

OTHER PUBLICATIONS

Exhibit 1: Four photos of a prior art case of Rehrig Pacific Company, Model No. PLBC-8-2L-PET-Qd (1984).

(Continued)

*Primary Examiner* — Mickey Yu
*Assistant Examiner* — Robert J Hicks
(74) *Attorney, Agent, or Firm* — Carlson, Gaskey & Olds

(57) ABSTRACT

A tray for storing and transporting bottles includes a plurality of spaced apart base walls each for supporting a bottle thereon. A plurality of interior columns extend upwardly between the base walls. Longitudinal dividers connect the interior columns. Lateral dividers connect the interior columns to side columns along side edges of the tray. The side columns have tapered mid-portions, such that upwardly-opening windows between side columns are contoured convexly.

27 Claims, 20 Drawing Sheets

U.S. PATENT DOCUMENTS

| | | | | |
|---|---|---|---|---|
| 2,979,222 | A | | 4/1961 | Levine |
| 3,009,579 | A | | 11/1961 | Ettlinger, Jr. |
| 3,055,531 | A | | 9/1962 | De Chelbor |
| 3,055,542 | A | | 9/1962 | Russo |
| 3,092,284 | A | | 6/1963 | Stout |
| D195,702 | S | | 7/1963 | Russo |
| 3,151,762 | A | | 10/1964 | Vidal |
| 3,184,148 | A | | 5/1965 | Poupitch |
| D201,257 | S | | 6/1965 | Vidal |
| 3,247,996 | A | | 4/1966 | Garcia |
| 3,283,947 | A | | 11/1966 | Cornelius |
| 3,297,190 | A | | 1/1967 | Cloyd |
| D208,111 | S | | 7/1967 | Vidal |
| 3,332,574 | A | | 7/1967 | Earp |
| 3,333,727 | A | | 8/1967 | Belcher et al. |
| 3,333,729 | A | | 8/1967 | Rabb |
| 3,334,767 | A | | 8/1967 | Cornelius et al. |
| 3,349,943 | A | | 10/1967 | Box |
| D209,864 | S | | 1/1968 | Versteeg et al. |
| 3,376,998 | A | | 4/1968 | Cornelius |
| 3,384,261 | A | | 5/1968 | Austin |
| 3,390,801 | A | | 7/1968 | Adomat |
| 3,391,814 | A | | 7/1968 | Box |
| 3,391,815 | A | | 7/1968 | Box |
| 3,392,869 | A | | 7/1968 | Needt |
| 3,416,694 | A | | 12/1968 | Bebb |
| 3,428,207 | A | | 2/1969 | Scholler |
| 3,517,852 | A | | 6/1970 | Schoeller |
| 3,628,684 | A | | 12/1971 | Sere |
| 3,638,824 | A | | 2/1972 | Sekiguchi et al. |
| 3,701,449 | A | | 10/1972 | Schoeller |
| 3,759,416 | A | | 9/1973 | Constantine |
| D229,674 | S | | 12/1973 | Quigg |
| 3,812,996 | A | | 5/1974 | Bunnell |
| 3,865,239 | A | | 2/1975 | Herolzer et al. |
| 3,949,876 | A | | 4/1976 | Bridges et al. |
| 3,991,879 | A | | 11/1976 | Hirota |
| 3,998,237 | A | | 12/1976 | Kressin et al. |
| 3,998,328 | A | | 12/1976 | Box |
| 4,027,796 | A | | 6/1977 | Martin |
| 4,037,722 | A | | 7/1977 | Bremer |
| 4,040,517 | A | | 8/1977 | Torokvei |
| 4,071,162 | A | | 1/1978 | Steinlein et al. |
| 4,095,720 | A | | 6/1978 | Delbrouck et al. |
| 4,101,049 | A | | 7/1978 | Wallace et al. |
| 4,161,259 | A | | 7/1979 | Palafox |
| 4,162,738 | A | | 7/1979 | Wright |
| 4,202,448 | A | | 5/1980 | Jaeger et al. |
| 4,204,596 | A | | 5/1980 | Davis |
| 4,319,685 | A | | 3/1982 | David |
| 4,343,400 | A | * | 8/1982 | Faucillon ..... 206/507 |
| 4,344,530 | A | | 8/1982 | deLarosiere |
| D266,709 | S | | 10/1982 | Box |
| 4,410,099 | A | | 10/1983 | deLarosiere |
| 4,416,373 | A | | 11/1983 | deLarosiere |
| D275,142 | S | | 8/1984 | Torokvei |
| 4,538,742 | A | | 9/1985 | Prodel |
| 4,548,320 | A | | 10/1985 | Box |
| D283,103 | S | | 3/1986 | Cushing et al. |
| D284,841 | S | | 7/1986 | Rowland et al. |
| D289,938 | S | | 5/1987 | Warwick |
| D291,178 | S | | 8/1987 | Toms |
| 4,700,836 | A | | 10/1987 | Hammett |
| 4,700,837 | A | | 10/1987 | Hammett |
| D295,107 | S | | 4/1988 | Frost |
| 4,773,554 | A | | 9/1988 | Warwick |
| 4,789,063 | A | | 12/1988 | Hammett |
| 4,848,580 | A | | 7/1989 | Wise |
| D304,123 | S | | 10/1989 | Warwick |
| 4,899,874 | A | | 2/1990 | Apps et al. |
| 4,911,303 | A | | 3/1990 | Andersson |
| 4,928,841 | A | | 5/1990 | Arthurs |
| 4,932,532 | A | | 6/1990 | Apps et al. |
| 4,978,000 | A | | 12/1990 | Mohr |
| 4,978,002 | A | | 12/1990 | Apps et al. |
| D313,493 | S | | 1/1991 | Apps et al. |
| D317,670 | S | | 6/1991 | Apps |
| D318,552 | S | | 7/1991 | Apps |
| 5,031,774 | A | | 7/1991 | Morris et al. |
| D319,129 | S | | 8/1991 | Apps et al. |
| D320,298 | S | | 9/1991 | Apps et al. |
| 5,060,819 | A | | 10/1991 | Apps |
| 5,071,026 | A | | 12/1991 | Apps |
| 5,096,085 | A | | 3/1992 | Eek et al. |
| D325,279 | S | | 4/1992 | Apps |
| 5,105,948 | A | | 4/1992 | Morris et al. |
| D326,749 | S | | 6/1992 | Apps et al. |
| D327,357 | S | | 6/1992 | Rehrig |
| D327,972 | S | | 7/1992 | Apps et al. |
| D329,931 | S | | 9/1992 | Apps |
| D329,932 | S | | 9/1992 | Apps |
| 5,184,748 | A | | 2/1993 | Apps |
| 5,267,649 | A | | 12/1993 | Apps et al. |
| 5,305,884 | A | | 4/1994 | Apps et al. |
| 5,316,172 | A | | 5/1994 | Apps et al. |
| 5,320,245 | A | | 6/1994 | Apps et al. |
| 5,335,814 | A | | 8/1994 | Hepp |
| D350,438 | S | | 9/1994 | Apps et al. |
| 5,351,814 | A | | 10/1994 | Apps |
| 5,377,862 | A | | 1/1995 | Oakes et al. |
| 5,405,042 | A | | 4/1995 | Apps et al. |
| 5,421,477 | A | | 6/1995 | Hammett |
| D360,758 | S | | 8/1995 | Umiker |
| D361,431 | S | | 8/1995 | Koefelda |
| 5,465,843 | A | | 11/1995 | Koefelda |
| 5,487,487 | A | | 1/1996 | Hammett |
| 5,495,945 | A | | 3/1996 | Apps et al. |
| 5,501,352 | A | | 3/1996 | Apps |
| 5,529,176 | A | | 6/1996 | Apps et al. |
| 5,575,390 | A | | 11/1996 | Apps et al. |
| D378,249 | S | | 3/1997 | Apps et al. |
| D379,121 | S | | 5/1997 | Apps et al. |
| D379,717 | S | | 6/1997 | Apps et al. |
| D380,613 | S | | 7/1997 | Apps et al. |
| D380,901 | S | | 7/1997 | Apps et al. |
| 5,651,461 | A | | 7/1997 | Apps et al. |
| 5,660,279 | A | | 8/1997 | Apps et al. |
| 5,669,498 | A | * | 9/1997 | Fierek et al. ..... 206/373 |
| 5,704,482 | A | | 1/1998 | Apps et al. |
| 5,769,230 | A | | 6/1998 | Koefelda |
| D395,954 | S | | 7/1998 | Apps et al. |
| D399,060 | S | | 10/1998 | Apps et al. |
| D400,012 | S | | 10/1998 | Apps |
| 5,823,376 | A | | 10/1998 | McGrath |
| D401,764 | S | | 12/1998 | Apps et al. |
| 5,842,572 | A | | 12/1998 | Apps et al. |
| D404,204 | S | | 1/1999 | Apps |
| 5,855,277 | A | | 1/1999 | Apps et al. |
| D410,778 | S | | 6/1999 | Apps et al. |
| D412,399 | S | | 8/1999 | Apps et al. |
| 5,964,343 | A | | 10/1999 | Steiner |
| 5,971,204 | A | | 10/1999 | Apps |
| 5,979,654 | A | | 11/1999 | Apps |
| D417,784 | S | | 12/1999 | Umiker |
| 6,006,912 | A | | 12/1999 | McGrath |
| D420,220 | S | | 2/2000 | Apps et al. |
| 6,047,844 | A | | 4/2000 | McGrath |
| 6,059,109 | A | * | 5/2000 | Stein ..... 206/373 |
| 6,073,793 | A | | 6/2000 | Apps et al. |
| 6,079,554 | A | | 6/2000 | Hammett et al. |
| 6,112,938 | A | | 9/2000 | Apps |
| 6,131,730 | A | | 10/2000 | Hsu |
| 6,189,734 | B1 | | 2/2001 | Apps et al. |
| 6,237,758 | B1 | | 5/2001 | Hsu |
| D446,015 | S | | 8/2001 | Apps |
| D461,957 | S | | 8/2002 | Hammett |
| D462,522 | S | | 9/2002 | Apps et al. |
| 6,454,120 | B1 | | 9/2002 | Hammett |
| 6,457,599 | B1 | | 10/2002 | Apps et al. |
| D465,417 | S | | 11/2002 | Apps |
| D466,018 | S | | 11/2002 | Apps |
| D468,634 | S | | 1/2003 | Hammett |
| D483,946 | S | | 12/2003 | Koefelda |
| D485,756 | S | | 1/2004 | Apps |
| D487,634 | S | | 3/2004 | Apps et al. |
| D494,867 | S | | 8/2004 | Apps |
| 6,851,563 | B1 | | 2/2005 | Lipari |

| | | | | |
|---|---|---|---|---|
| D505,014 | S | 5/2005 | Apps et al. | |
| 6,892,885 | B2 | 5/2005 | Apps et al. | |
| 6,899,247 | B1 | 5/2005 | Koefelda et al. | |
| D507,880 | S | 8/2005 | Hassell et al. | |
| 6,966,442 | B2 | 11/2005 | Hassell et al. | |
| 7,017,746 | B2 | 3/2006 | Apps | |
| 7,086,531 | B2 | 8/2006 | Apps et al. | |
| 7,097,033 | B2 | 8/2006 | Koefelda et al. | |
| 7,128,234 | B2 | 10/2006 | Apps et al. | |
| 7,207,458 | B1 | 4/2007 | Koefelda et al. | |
| 7,252,196 | B1 | 8/2007 | Koefelda et al. | |
| 7,281,641 | B2 | 10/2007 | Apps | |
| 7,311,217 | B2 | 12/2007 | Apps | |
| 7,322,475 | B2 | 1/2008 | Hassell et al. | |
| 7,322,486 | B2 | 1/2008 | Koefelda et al. | |
| 7,549,539 | B2 | 6/2009 | Apps | |
| 7,604,122 | B2 | 10/2009 | Apps et al. | |
| 7,677,405 | B2 | 3/2010 | Apps et al. | |
| 7,694,839 | B2 | 4/2010 | Koefelda et al. | |
| D615,758 | S | 5/2010 | Lindstrom | |
| 7,735,676 | B2 | 6/2010 | Ogburn | |
| 7,743,939 | B2 | 6/2010 | Stahl | |
| 7,950,521 | B2 | 5/2011 | Apps | |
| 8,056,753 | B2 | 11/2011 | Koefelda et al. | |
| 2001/0015329 | A1* | 8/2001 | Apps et al. | 206/427 |
| 2002/0148837 | A1 | 10/2002 | Apps | |
| 2002/0195452 | A1 | 12/2002 | Apps | |
| 2003/0057211 | A1* | 3/2003 | Koefelda et al. | 220/518 |
| 2005/0072710 | A1* | 4/2005 | Hammett et al. | 206/507 |

FOREIGN PATENT DOCUMENTS

| | | |
|---|---|---|
| BE | 693216 | 1/1967 |
| CA | 965056 | 3/1975 |
| CA | 1109433 | 9/1981 |
| DE | 1207268 | 12/1965 |
| EP | 0099827 | 10/1986 |
| EP | 0210712 | 8/1990 |
| EP | 0 464 894 | 1/1992 |
| EP | 1008527 | 11/1999 |
| EP | 2 107 006 | 10/2009 |
| FR | 1285689 | 1/1962 |
| FR | 1350962 | 1/1963 |
| FR | 1350962 | 12/1963 |
| FR | 1351218 | 12/1963 |
| FR | 1518610 | 2/1968 |
| FR | 2302244 | 2/1975 |
| FR | 2302244 | 9/1976 |
| GB | 758817 | 10/1956 |
| GB | 943947 | 12/1963 |
| GB | 1032916 | 6/1966 |
| GB | 1115343 | 5/1968 |
| GB | 1120067 | 7/1968 |
| GB | 1152038 | 5/1969 |
| GB | 1312701 | 4/1973 |
| GB | 1319726 | 6/1973 |
| GB | 1330778 | 9/1973 |
| GB | 2 017 645 | 10/1979 |
| GB | 2079256 | 1/1982 |
| GB | 2135278 | 8/1984 |
| GB | 2158044 | 11/1985 |
| NL | 6505562 | 10/1966 |
| WO | 82/01536 | 5/1982 |
| WO | 96/40566 | 12/1996 |
| WO | 98/07636 | 2/1998 |
| WO | 00/41937 | 7/2000 |
| WO | 2006/026783 | 3/2006 |
| WO | 2009/043038 | 4/2009 |

OTHER PUBLICATIONS

Exhibit 2: Two photos of a prior art case of Rehrig Pacific Company for 3 liter PET bottles (1990).
Exhibit 3: Two photos of a prior art case of D.W. Plastics (date unknown).
Exhibit 4: Two photos of a prior art case of International Container Systems, Inc. for 3 liter PET bottles (date unknown).
European Search Report for European Application No. 09156468.2, May 27, 2009.
European Search Report for EP Application No. 09012596.4, Jan. 25, 2010.
European Search Report for EP Application No. 09012612.9, Jan. 8, 2010.
U.S. Appl. No. 12/573,409, filed Oct. 5, 2009, "Stackable Low Depth Tray".
U.S. Appl. No. 12/556,616, filed Sep. 10, 2009, "Stackable Low Depth Tray".
U.S. Appl. No. 12/059,857, filed Mar. 31, 2008, "Stackable Low Depth Tray".
U.S. Appl. No. 12/619,143, filed Nov. 16, 2009, "Low Depth Crate".
U.S. Appl. No. 61/167,776, filed Apr. 8, 2009, "Stackable Low Depth Tray".
U.S. Appl. No. 61/184,768, filed Jun. 5, 2009, "Stackable Low Depth Tray".
European Search Report for EP Application No. 11194661.2, Jan. 19, 2012.
Photograph of Pepsi—Blue Crate, Top View.
Photograph of Pepsi—Blue Crate, Bottom View 1.
Photograph of Pepsi—Blue Crate, Bottom View 2.
Photograph of Norseman NPL 405 Crate, Top View.
Photograph of Norseman NPL 405 Crate, Bottom View.
Photograph of Coca Cola Crate, Top View.
Photograph of Coca Cola Crate, Bottom View.
Photograph of 2L Coca Cola "Tulip" Crate, Top View.
Photograph of 2L Coca Cola "Tulip" Crate, Bottom View 1.
Photograph of 2L Coca Cola "Tulip" Crate, Bottom View 2.
Photograph of 2L Coca Cola "Tulip" Crate, Bottom View 3.

* cited by examiner

STACKABLE LOW DEPTH TRAY

This application claims priority to U.S. Provisional Application Ser. No. 61/102,965, filed Oct. 6, 2008.

BACKGROUND OF THE INVENTION

The present invention relates to a stackable low depth tray for storing and transporting beverages containers, such as bottles.

Plastic bottles are widely used as containers for soft drinks and other beverages. These bottles are often stored and transported in trays, particularly plastic trays. There are many known tray designs that are referred to as "low depth" trays in which the side and end walls are lower than the height of the stored bottles, and in which the bottles support the weight of additional trays and bottles stacked thereon.

SUMMARY OF THE INVENTION

A tray according to one embodiment of the present invention includes a base having a plurality of spaced-apart base walls and a plurality of interior columns. A plurality of longitudinal dividers connect the interior columns to one another, and a plurality of lateral dividers extending laterally from the interior columns, such that bottle receiving pockets are separated from one another by the longitudinal dividers and the lateral dividers. A plurality of side columns are connected to one of the interior columns by one of the lateral dividers. The side columns are spaced apart to define upwardly-open windows aligned with each of the bottle-receiving pockets. The windows provide increased visibility to the bottles.

In another feature of the present invention, the side columns have tapered mid-portions, such that the windows are contoured convexly.

These and other features of the application can be best understood from the following specification and drawings, the following of which is a brief description.

DETAILED DESCRIPTION OF THE PREFERRED EMBODIMENT

Figure 1:
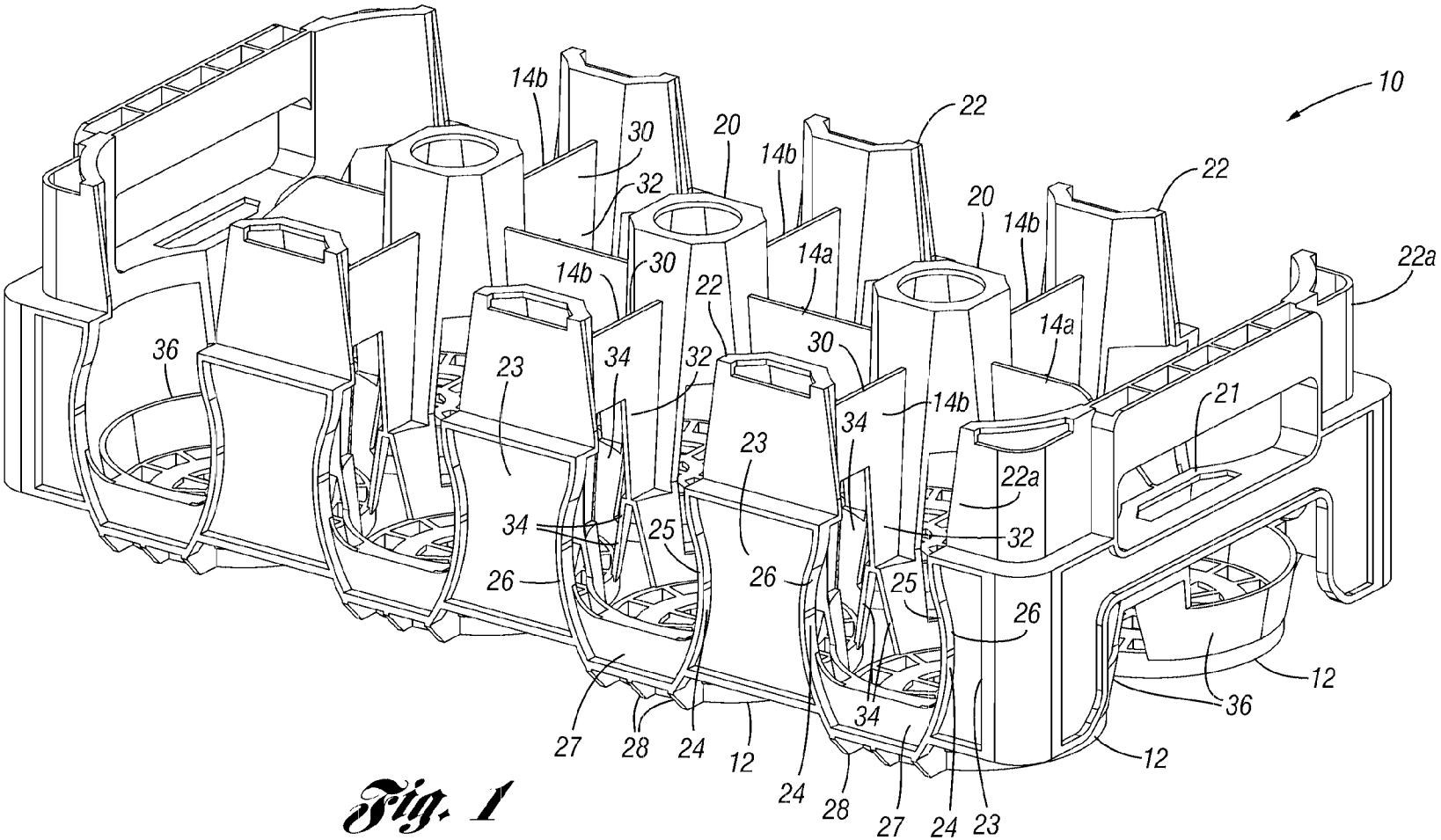
FIG. 1 is a perspective view of a tray according to one embodiment of the present invention.

A tray 10 according to one embodiment of the present invention is shown in FIG. 1. The tray 10 includes a plurality (in this example, eight) of spaced apart base walls 12. A plurality of longitudinal dividers 14*a* and a plurality of lateral dividers 14*b* (or, together "dividers 14") extend outward from a plurality of interior columns 20 which, together with the base walls 12, longitudinal dividers 14*a* and lateral dividers 14*b* define a plurality of bottle receiving pockets. The interior columns 20 are arranged generally along a longitudinal centerline of the tray 10. End longitudinal dividers 14*a* each extend from one interior column 20 to a handle structure 21.

The lateral dividers 14*b* each connect one of the interior columns 20 with one of a plurality of side columns 22 positioned along a side edge of the tray 10. The side columns 22 include four corner columns 22*a* extending upwardly from the corners of the tray 10. Each of the side columns 22 has a tapered mid-portion 23 having concave lateral edges 24 defining window openings 25 aligned with the base walls 12 and the bottle receiving pockets. Note that the corner columns 22*a* each have only one lateral edge 24 adjacent a window opening 25. An outer surface of each side column 22 includes a peripheral rib 26 protruding therefrom to emphasize the contoured shape of the side column 22. The contoured shape of the side columns 22 and the window openings 25 defined thereby promote the contoured shape of bottles to be shipped and displayed in the tray 10. A lower wall portion 27 extends upwardly to define a lower edge of each upwardly-opening window opening 25. The lower wall portion 27 is connected to the adjacent base wall 12 by a plurality of ribs 28 that are transverse to the lower wall portion 27 and the base wall 12.

The dividers 14 each have a lower end including two pair of spaced apart interior pocket walls 34, two of each pair connected to a different base wall 12. End pocket walls 36 protrude upwardly from ends of the end base walls 12. The pocket walls 34, 36 each have a concave interior surface and convexly curved exterior surface to define a generally cylindrical broken inner surface and a generally cylindrical broken outer surface around each base wall 12. The pocket walls 34, 36 and base walls 12 define lower pocket portions.

Figure 2:
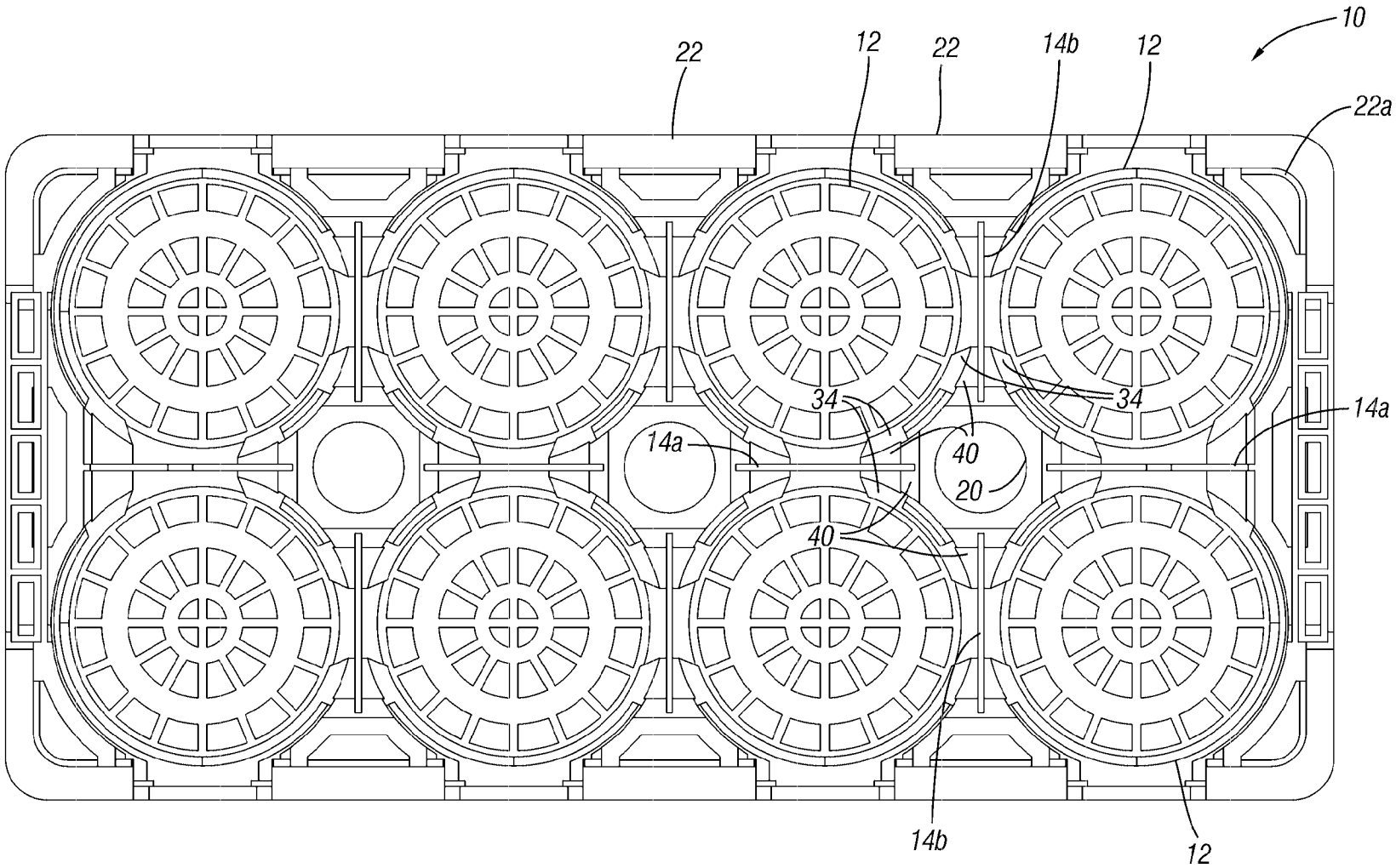
FIG. 2 is a top view of the tray of FIG. 1.

As shown in the top view of FIG. 2, the dividers 14 each include a laterally diverging wall 40 (or horizontal wall 40) from which the interior pocket walls 34 depend downwardly to the base wall 12.

Figure 3:
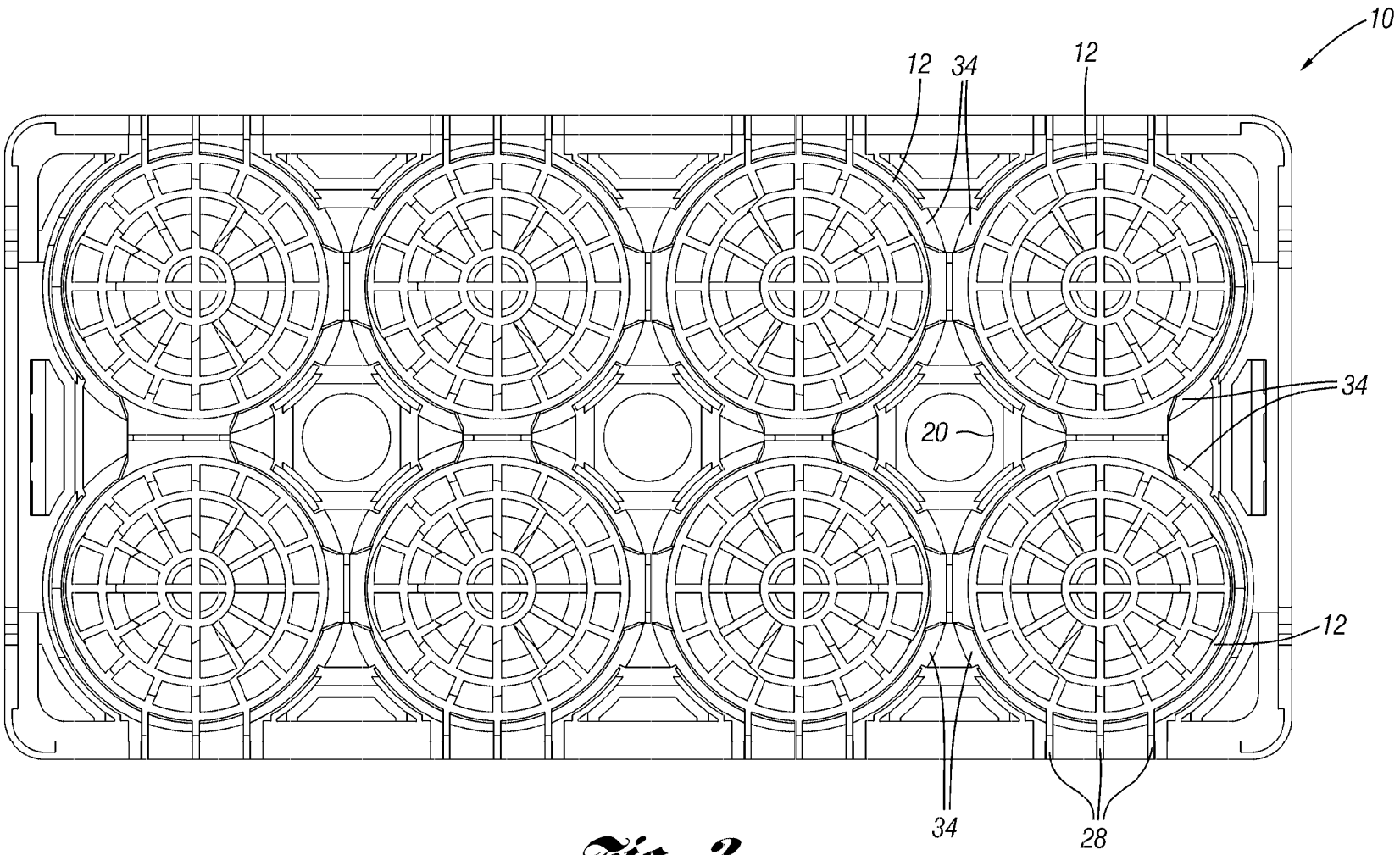
FIG. 3 is a bottom view of the tray of FIG. 2.

FIG. 3 is a bottom view of the tray 10, showing the spaced apart pocket walls 34 between the base walls 12.

Figure 4:
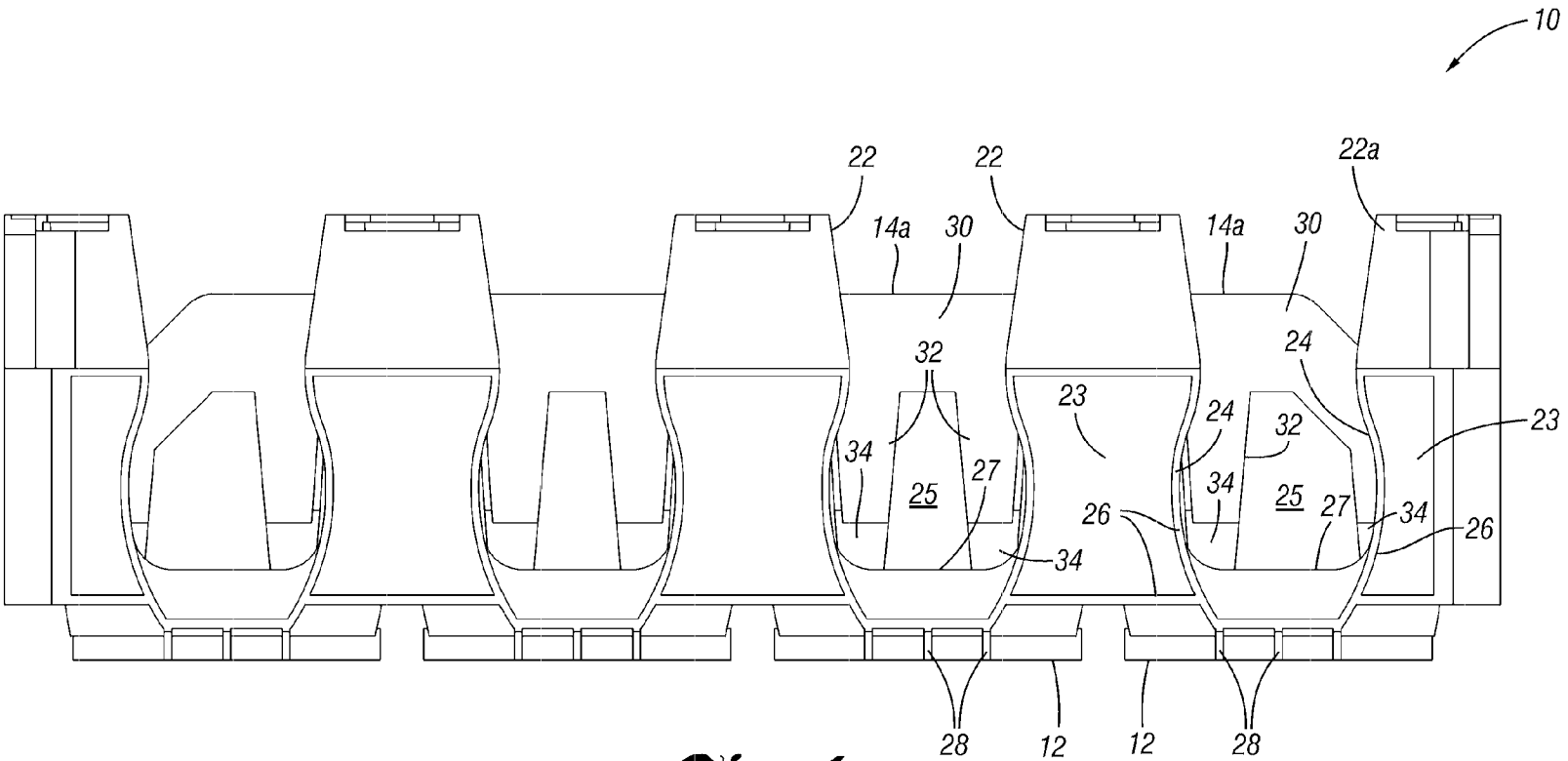
FIG. 4 is a side view of the tray.

FIG. 4 is a side view of the tray 10. Again, the side columns 22 each have a tapered mid-portion 23 having concave lateral edges 24 defining window openings 25 aligned with the base walls 12 and the bottle receiving pockets. Alternatively, only one or a plurality, but less than all, of the side columns 22 could be so contoured. Further, it is not required that all of the pockets have the adjacent window openings 25.

Still referring to FIG. 4, as shown, the upper portion of each divider 14 includes a header portion 30 that extends directly between adjacent structures (e.g. between adjacent interior columns 20, side columns 22 and/or handle) and spaced apart leg portions 32 that are coplanar with the header portion 30. The opening formed between the leg portions 32 reduces the overall weight of the tray 10 without decreasing the rigidity, because the header portion 30 extends solidly where it is most needed. The lower end of each divider 14 then includes the two pairs of spaced apart interior pocket walls 34 extending downward to the base walls 12. (The header portions 30 and leg portions 32 of the longitudinal dividers 14*a* are shown in FIG. 4, while the header portions 30 and leg portions 32 of the lateral dividers 14*b* are shown in FIG. 1. It would be possible to substitute one or more of the dividers 14 with solid walls or header portions 30 of different sizes depending on the particular strength to weight ratio desired.)

Figure 5:
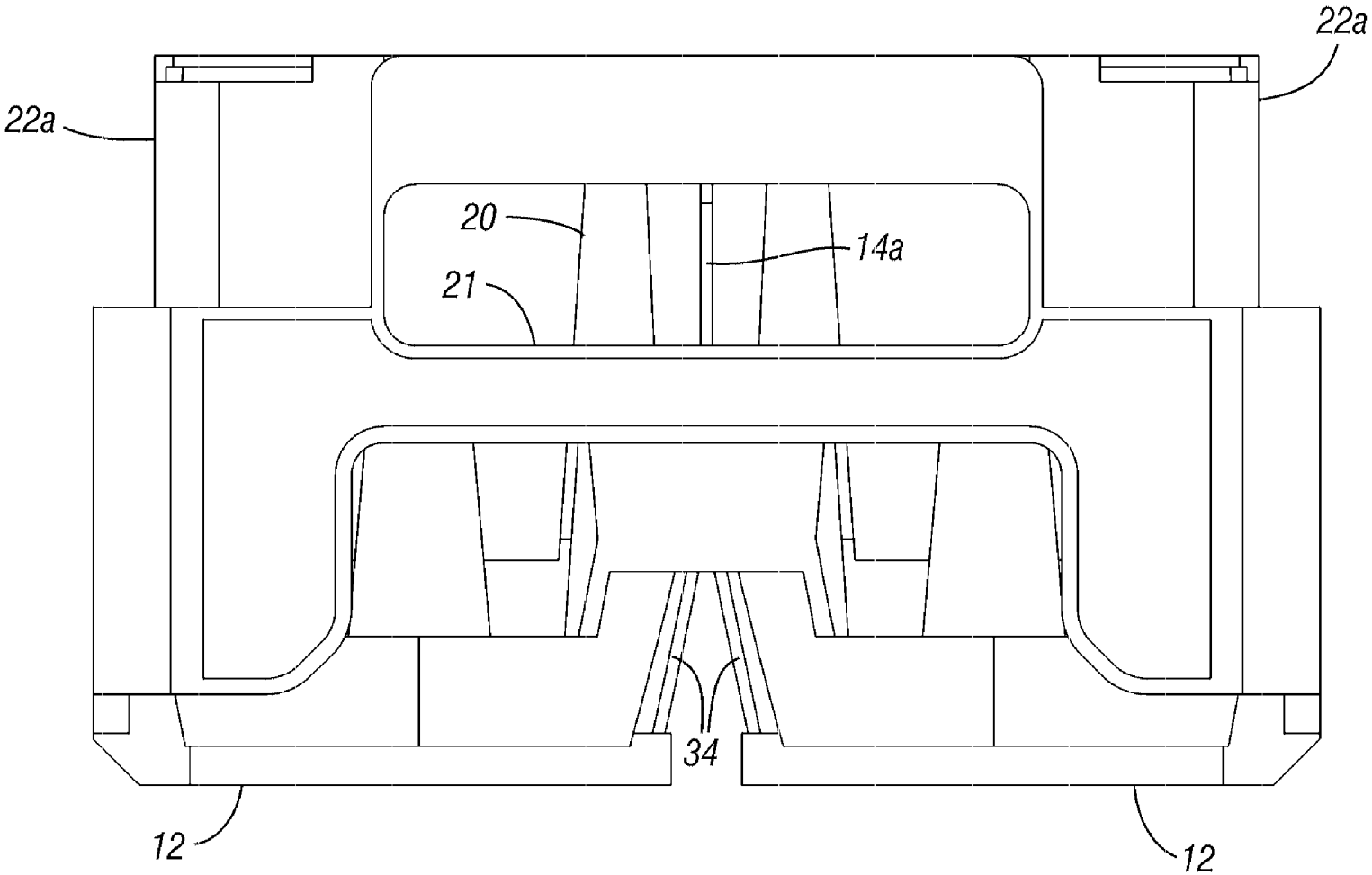
FIG. 5 is an end view of the tray.

FIG. 5 is an end view of the tray 10. As shown, the spaced apart pocket walls 34 connect the longitudinal dividers 14*a* to the base walls 12.

Figure 6:
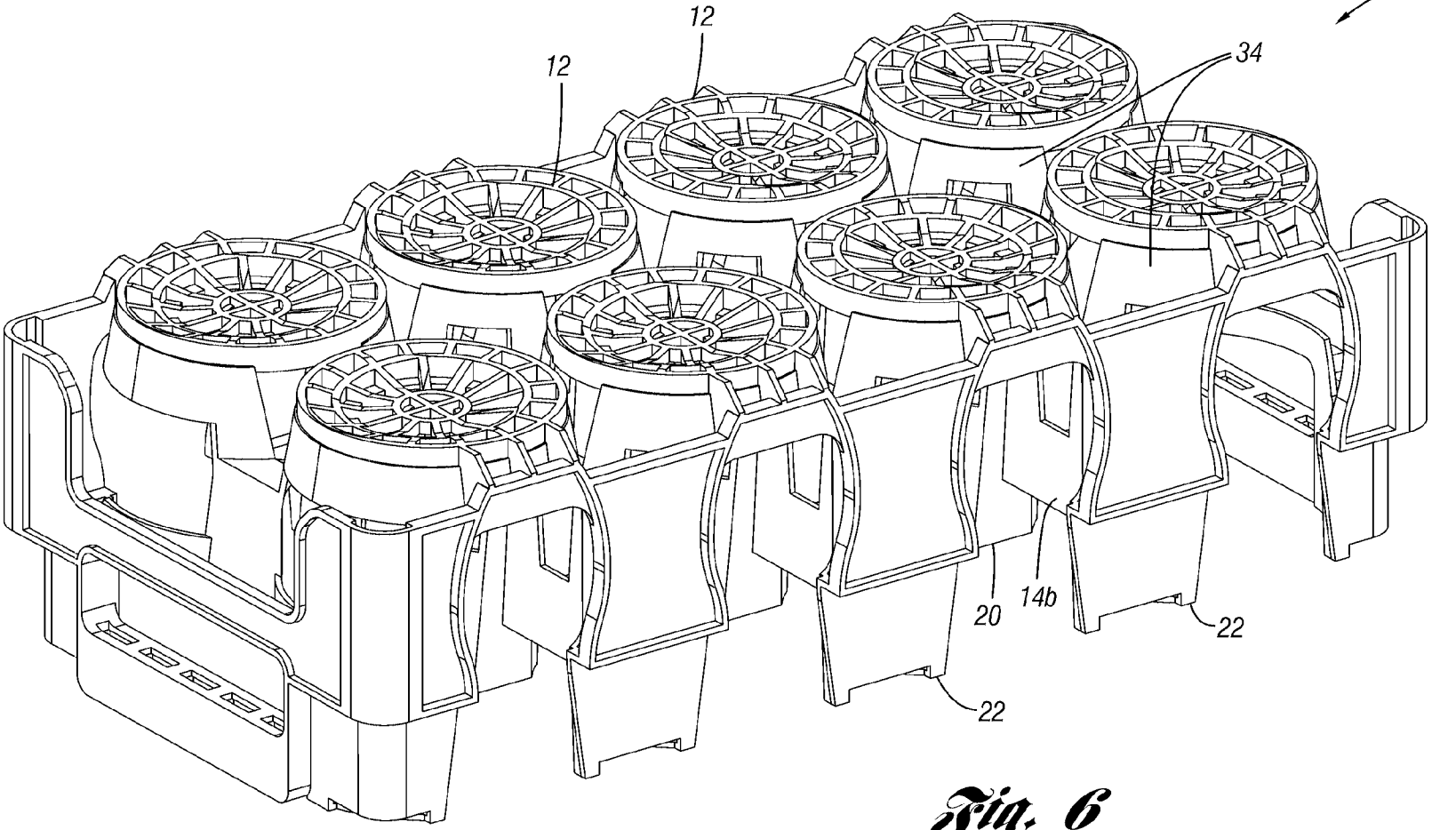
FIG. 6 is a bottom perspective view of the tray.

FIG. 6 is a bottom perspective view of the tray 10. The base walls 12 are spaced apart for the purpose of receiving therebetween the dividers 14 of a similar tray 10 on which the tray 10 is stacked. The base walls 12 are equally-spaced in the longitudinal and lateral directions.

Figure 7:
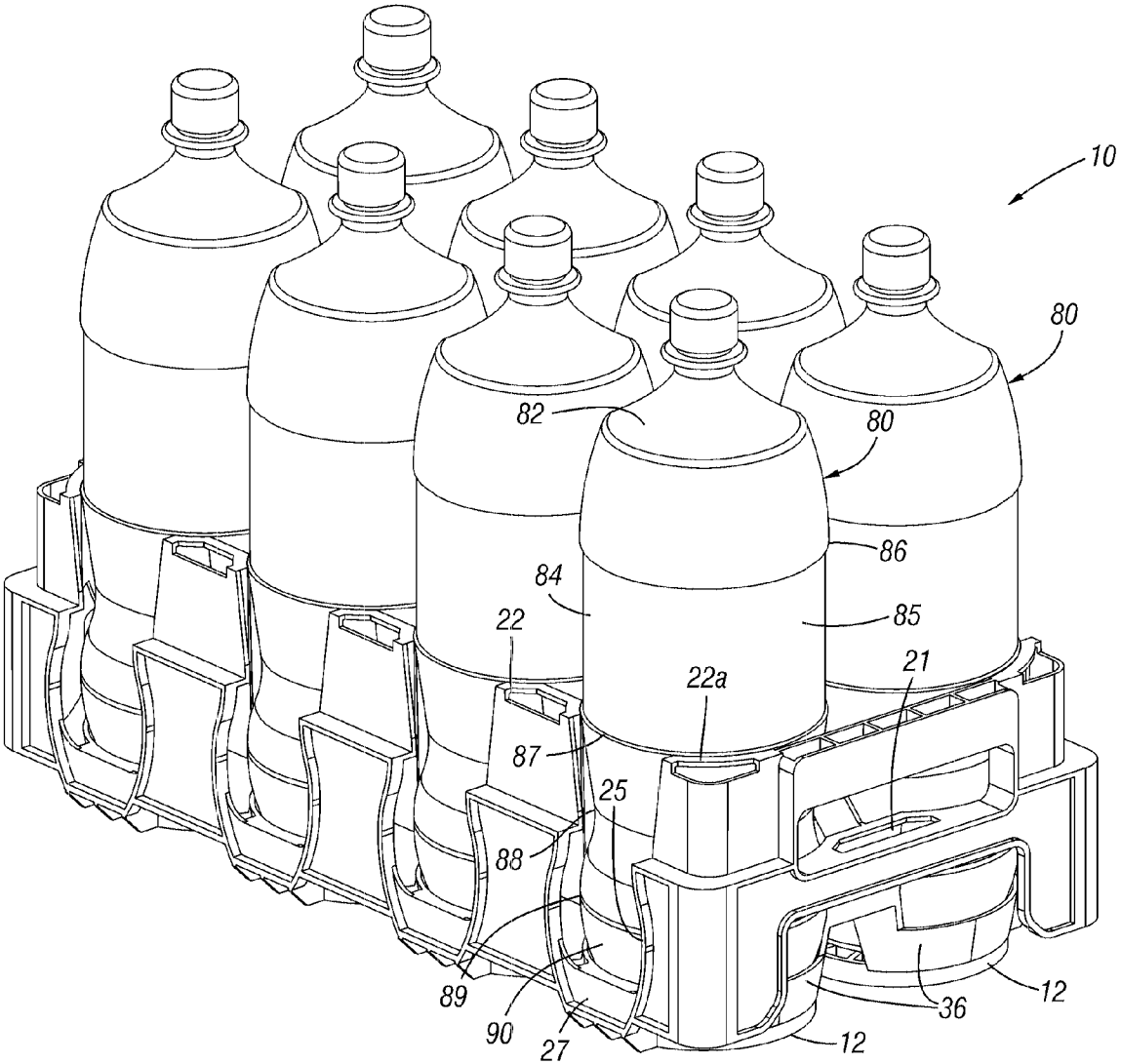
FIG. 7 is a perspective view of the tray of FIG. 1 with a plurality of bottles.

FIG. 7 is a perspective view of the tray 10 holding a plurality of bottles 80. Although other size and shape bottles 80 may be used, the tray 10 is particularly designed to hold multi-serving contoured plastic bottles 80, such as contoured 2-liter plastic bottles 80. The bottles 80 in this example have a neck portion 82 and a body portion 84. The body portion 84 includes a slightly recessed label area 85 having an upper label bumper portion 86 above it and a lower label bumper portion 87 below it. Below the lower label bumper portion 87 is a tapered narrow portion 88 having a heel bumper 89 below that. The upper label bumper portion 86, lower label bumper portion 87 and heel bumper 89 are all nominally at a maximum diameter of the bottle 80 (subject to normal manufacturing fluctuation and fluctuation based upon pressure in the bottle 80). A tapered base 90 is formed below the heel bumper 89.

Figure 8:
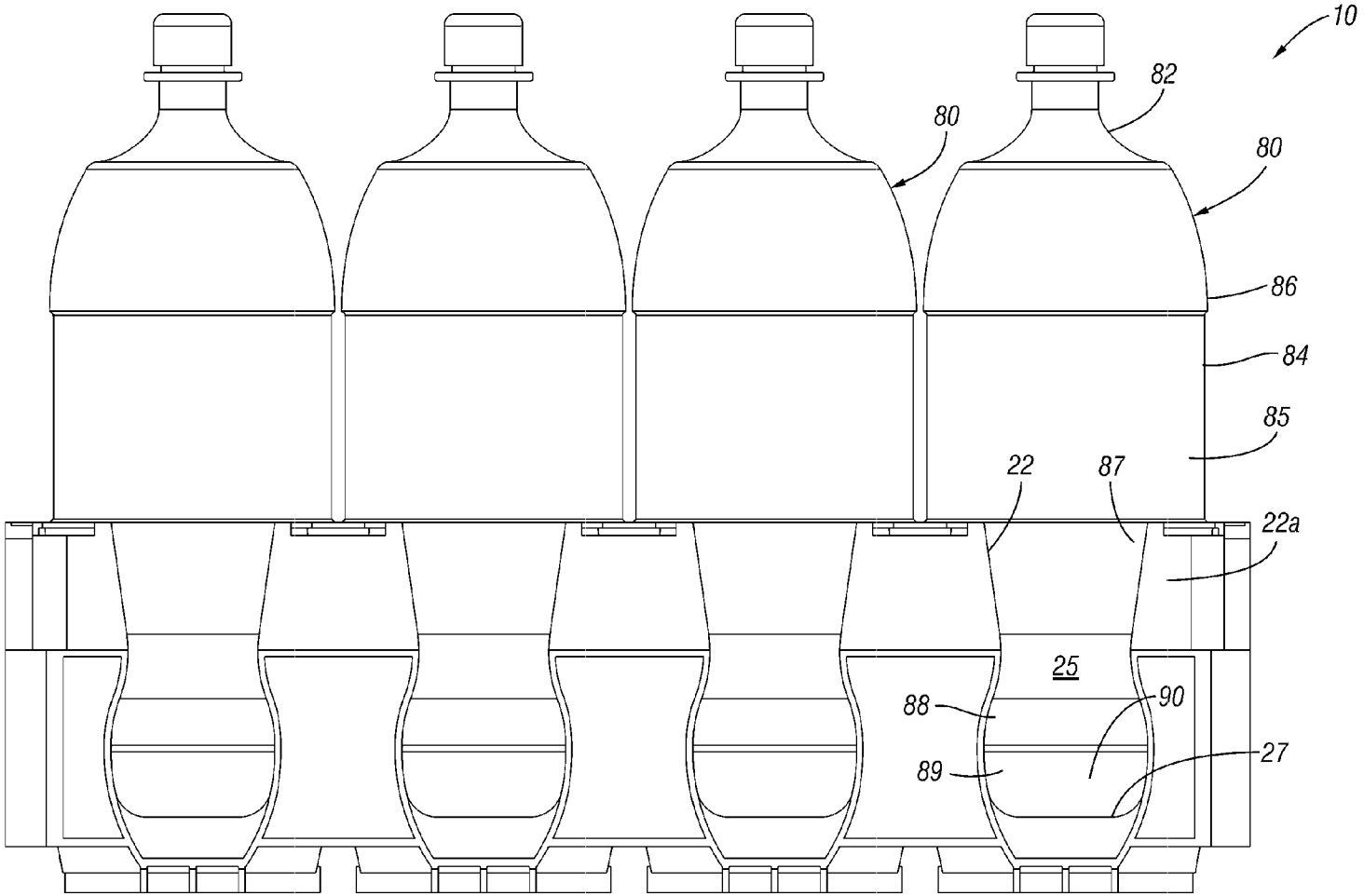
FIG. 8 is a side view of the tray and bottles of FIG. 7.

As shown in the illustrated example, the side columns 22 are tall enough to contact the lower label bumper portion 87 of the bottles 80. The base 90 of the bottle 80 is received snugly within the pocket formed by the lower wall portion 27 and pocket walls 34, 36 (FIG. 1). The window openings 25 emphasize the contour shape of the bottles 80 and expose a substantial portion of the bottles 80 for view, as shown in FIG. 8. Thus, stability and visibility of the bottles 80 is provided.

Figure 9:
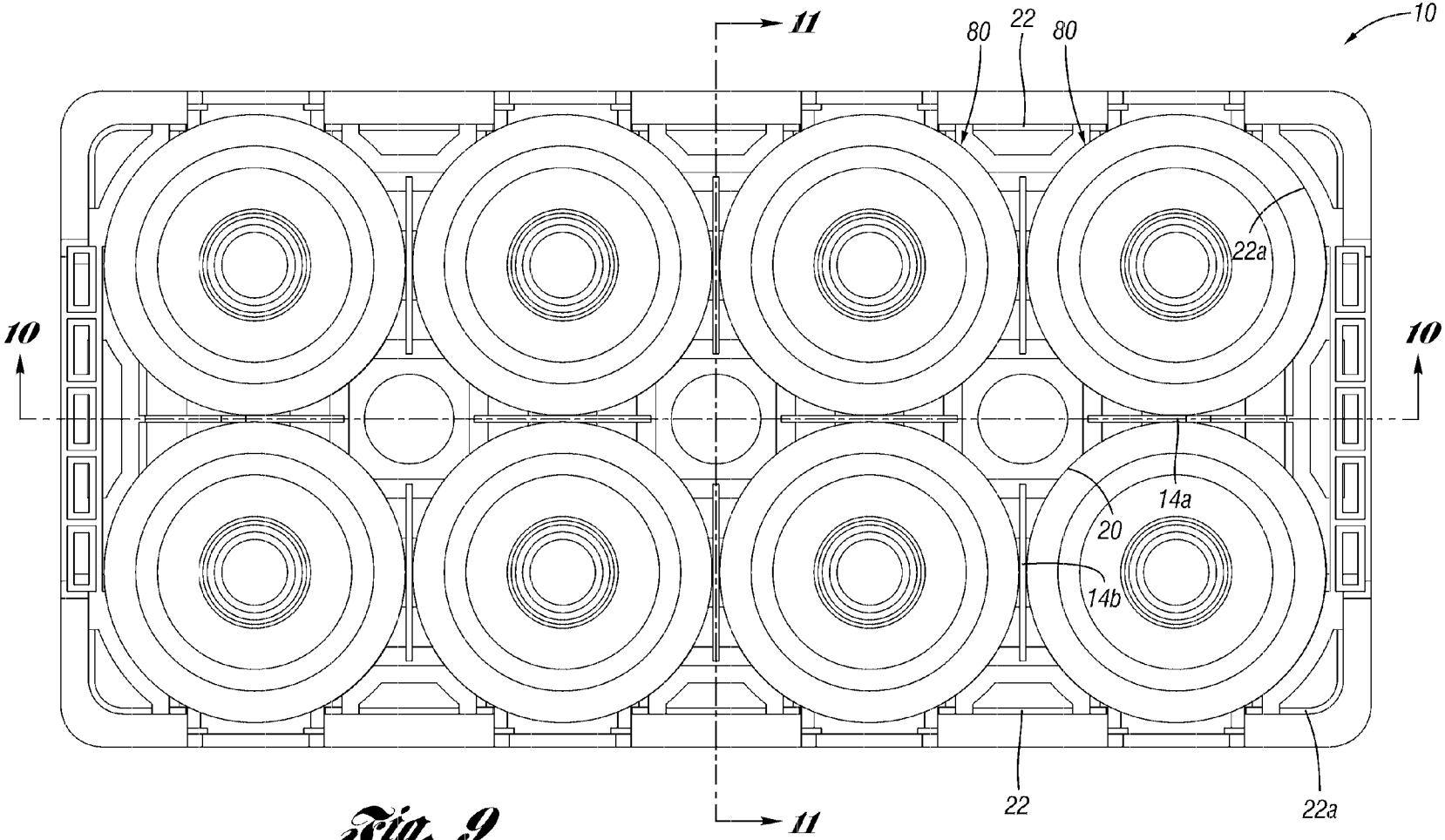
FIG. 9 is a top view of the tray and bottles of FIG. 7.
Figure 10:
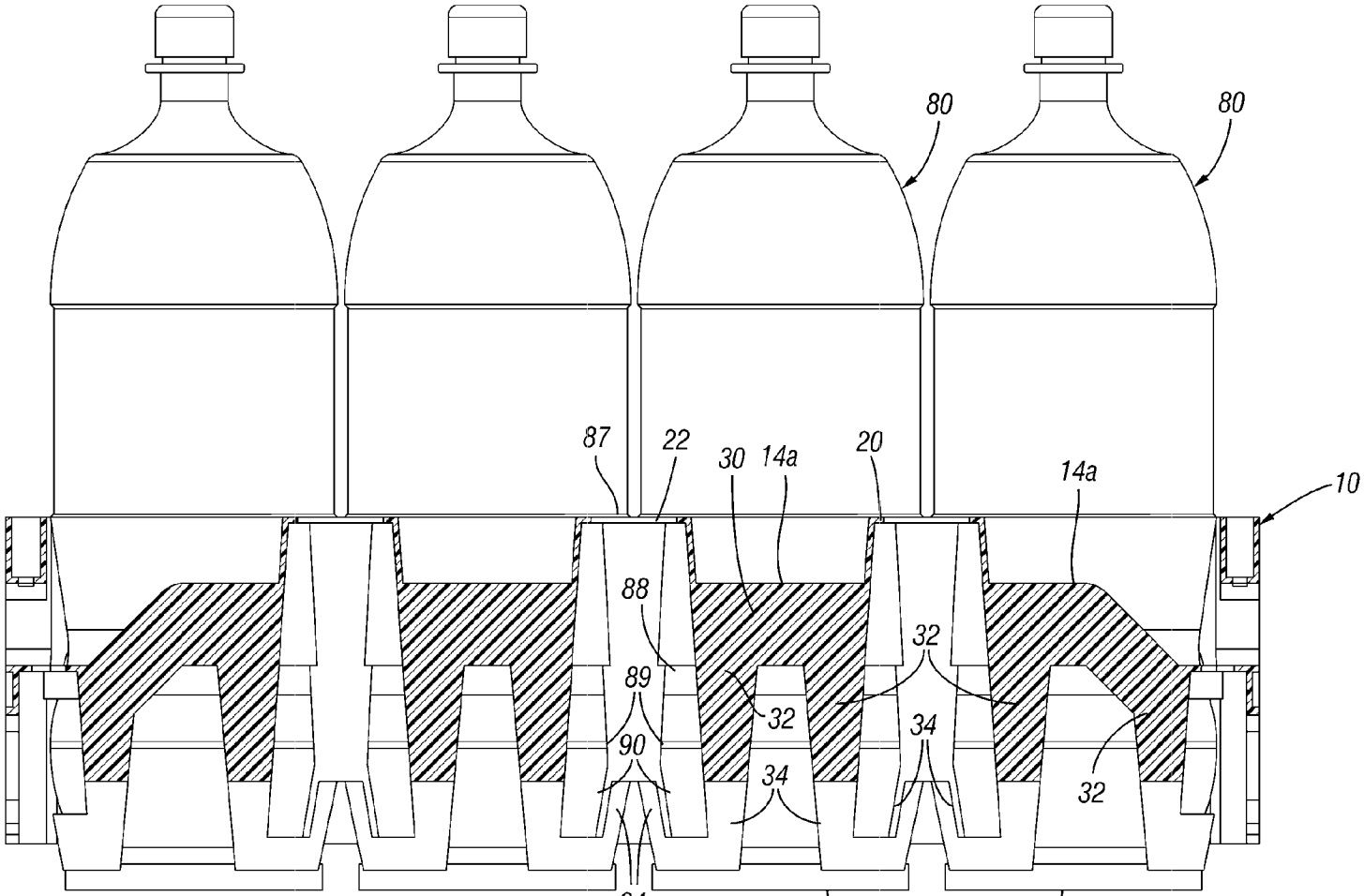
FIG. 10 is a section view taken along line 10-10 of FIG. 7.
Figure 11:
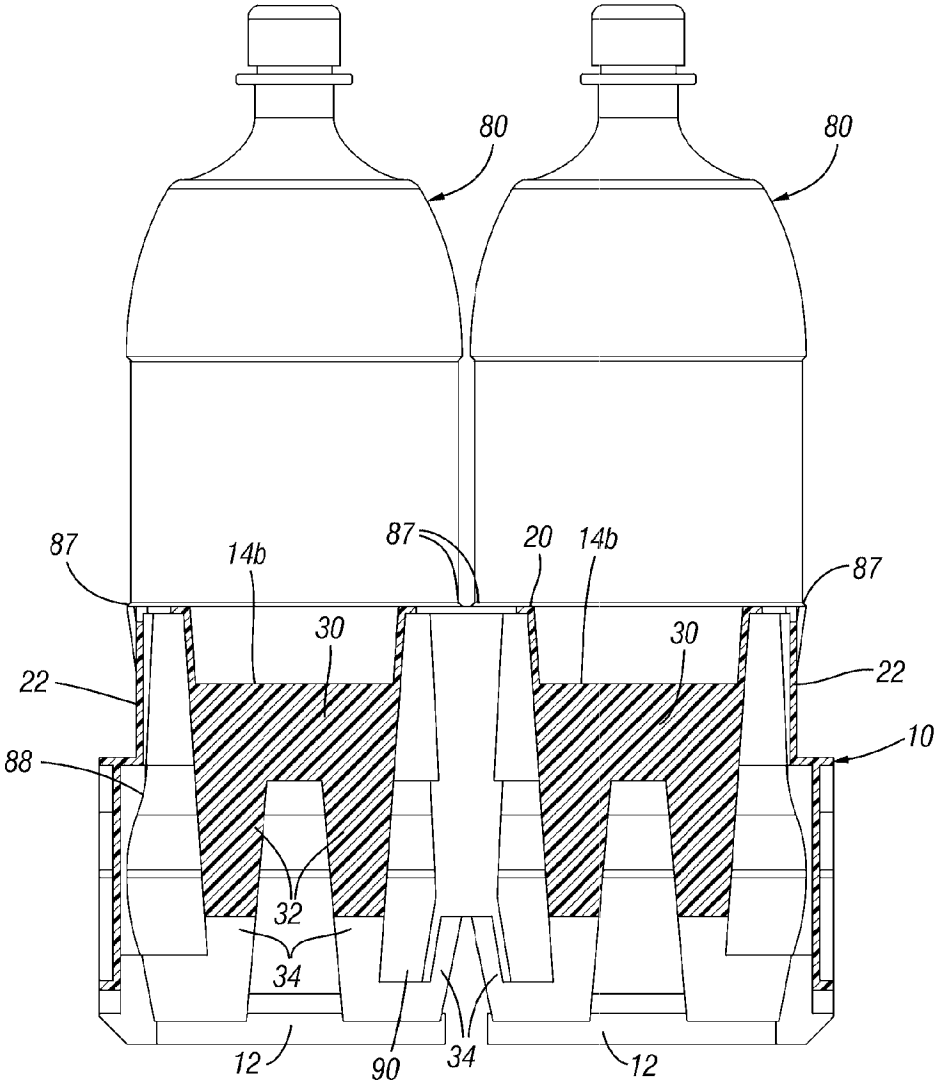
FIG. 11 is a section view taken along line 11-11 of FIG. 7.

FIG. 9 is a top view of the tray 10 and bottles 80 of FIGS. 7 and 8. FIG. 10 is a section view taken along line 10-10 of FIG. 9. As shown in FIG. 10, the spaced apart pocket walls 34 contact the base 90 of the bottles 80. The side columns 22 contact the lower label bumper portions 87 of the bottles 80. FIG. 11 is a section view taken along line 11-11 of FIG. 9. Again, the lateral dividers 14*b* connect to the base 12 via the pocket walls 34.

Figure 12:
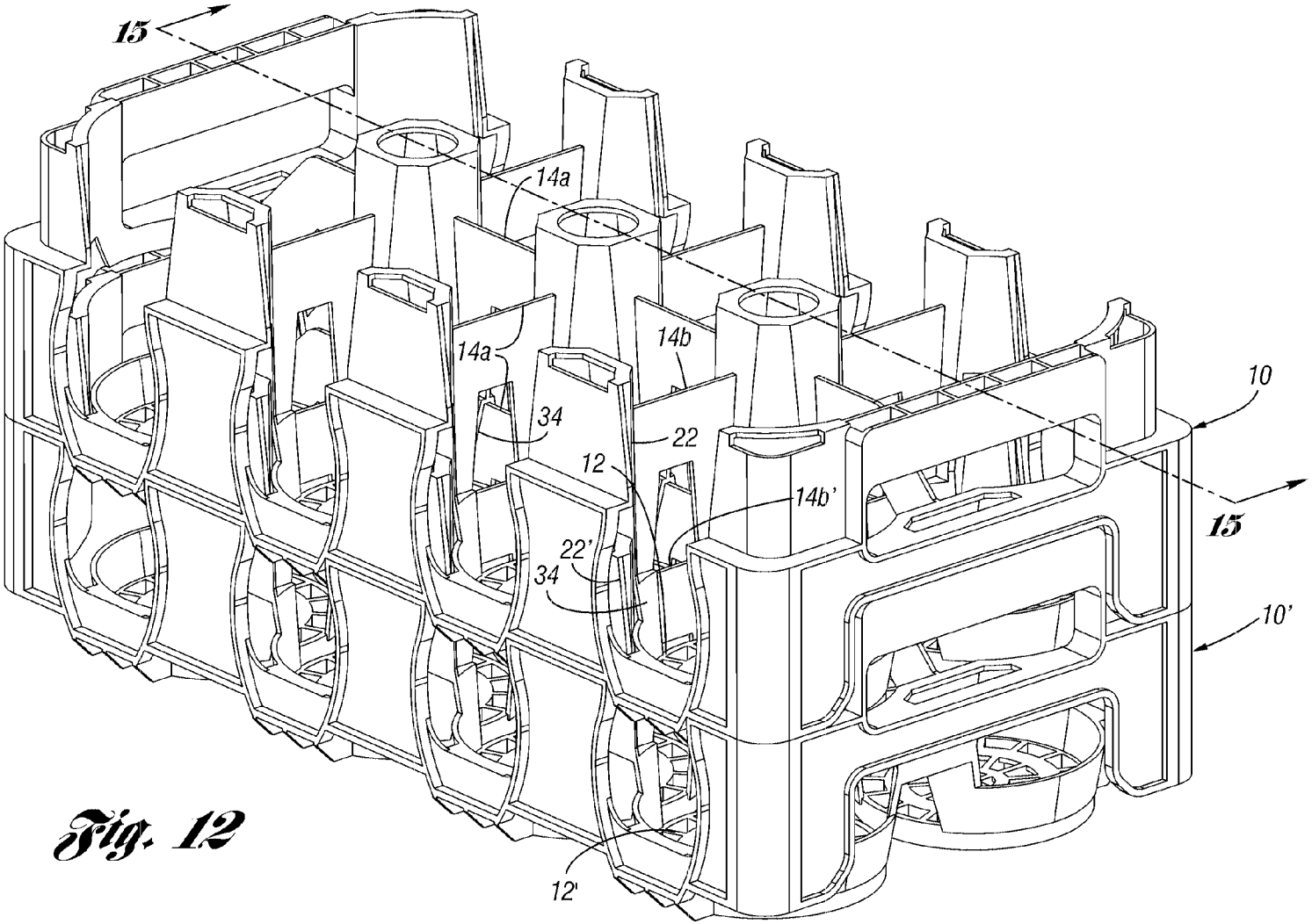
FIG. 12 is a perspective of the tray stacked on a similar tray.

As shown in FIG. 12, when the tray 10 is empty, it can be nested with a similar tray 10' to reduce empty stacking height. In the example, the tray 10 is nested on tray 10', but it should be appreciated that many trays 10 would be stacked on one another in this manner. When the upper tray 10 is nested on the lower tray 10', upper portions of the columns 22' of the lower tray 10' are received within lower portions of the columns 22' of the upper tray 10. Further, the longitudinal dividers 14*a*' and lateral dividers 14*b*' are received between the pocket walls 34 of both the longitudinal dividers 14*a* and the lateral dividers 14*b*, respectively.

Figure 13:
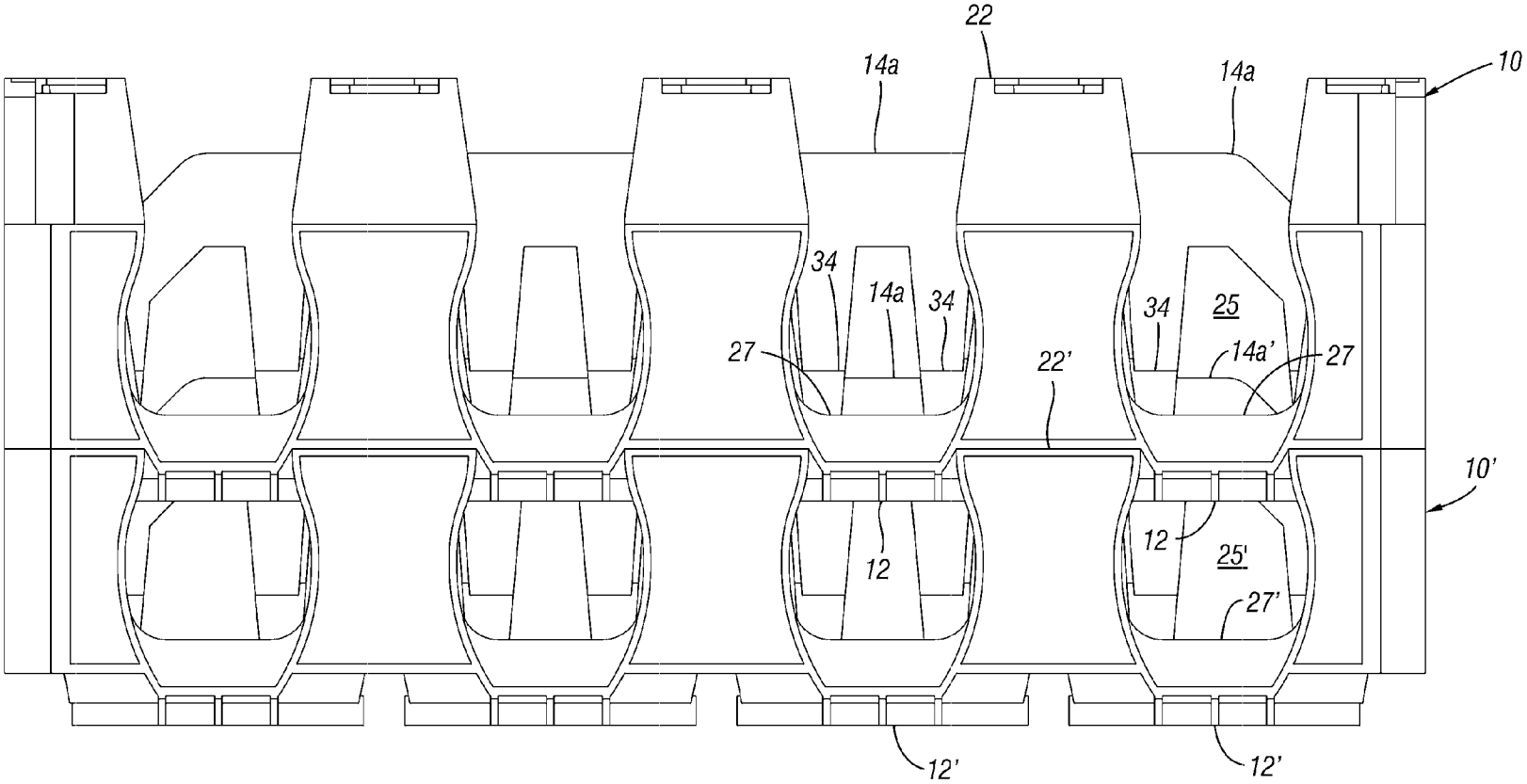
FIG. 13 is a side view of the trays of FIG. 12.

FIG. 13 is a side view of the nested trays 10, 10' of FIG. 12. As shown, when nested, the longitudinal dividers 14*a*' of the lower tray 10' extend upwardly higher than the lower wall portion 27 of the upper tray 10.

Figure 14:
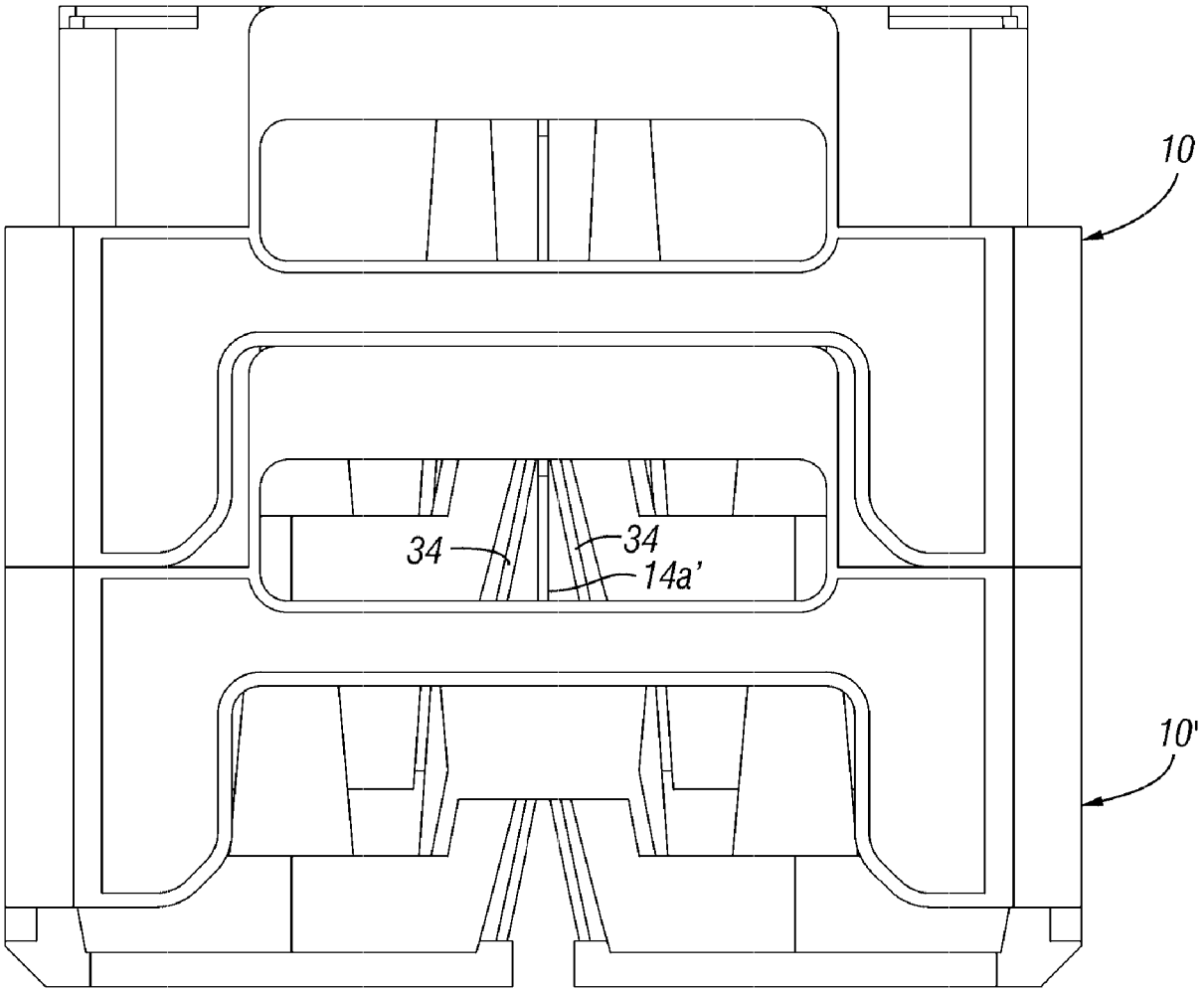
FIG. 14 is an end view of the trays of FIG. 13.

FIG. 14 is an end view of the nested trays 10, 10'. As shown, the longitudinal dividers 14*a*' of the lower tray 10' are received between the spaced apart pocket walls 34 of the upper tray 10.

Figure 15:
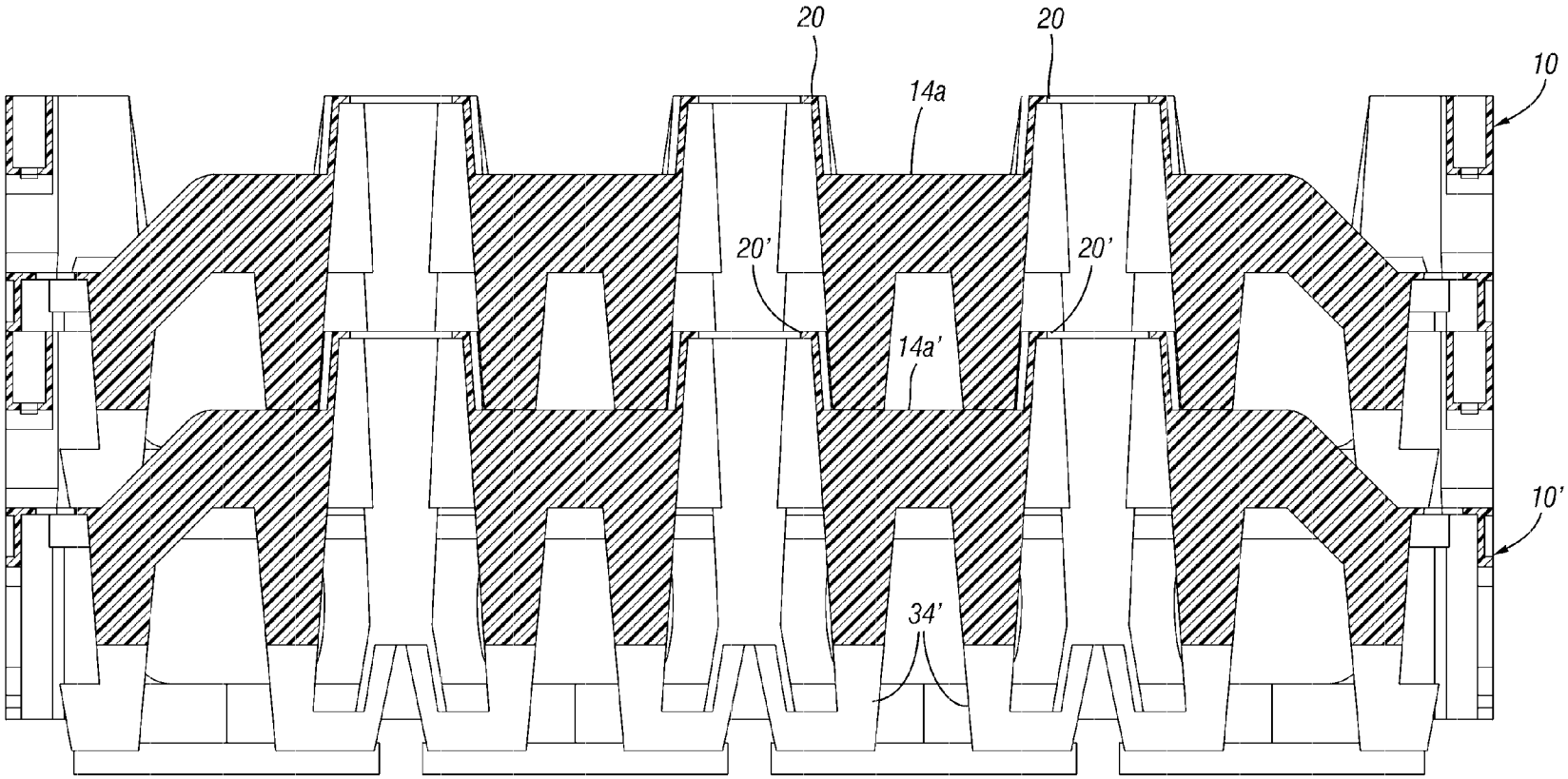
FIG. 15 is a section view taken along line 15-15 of FIG. 12.

FIG. 15 is a section view taken along line 15-15 of FIG. 12. The interior columns 20' of the lower tray 10' are received partially within the interior columns 20 of the upper tray 10. The longitudinal dividers 14*a* of the upper tray 10 are stacked on the longitudinal dividers 14*a*' of the lower tray 10.

Figure 16:
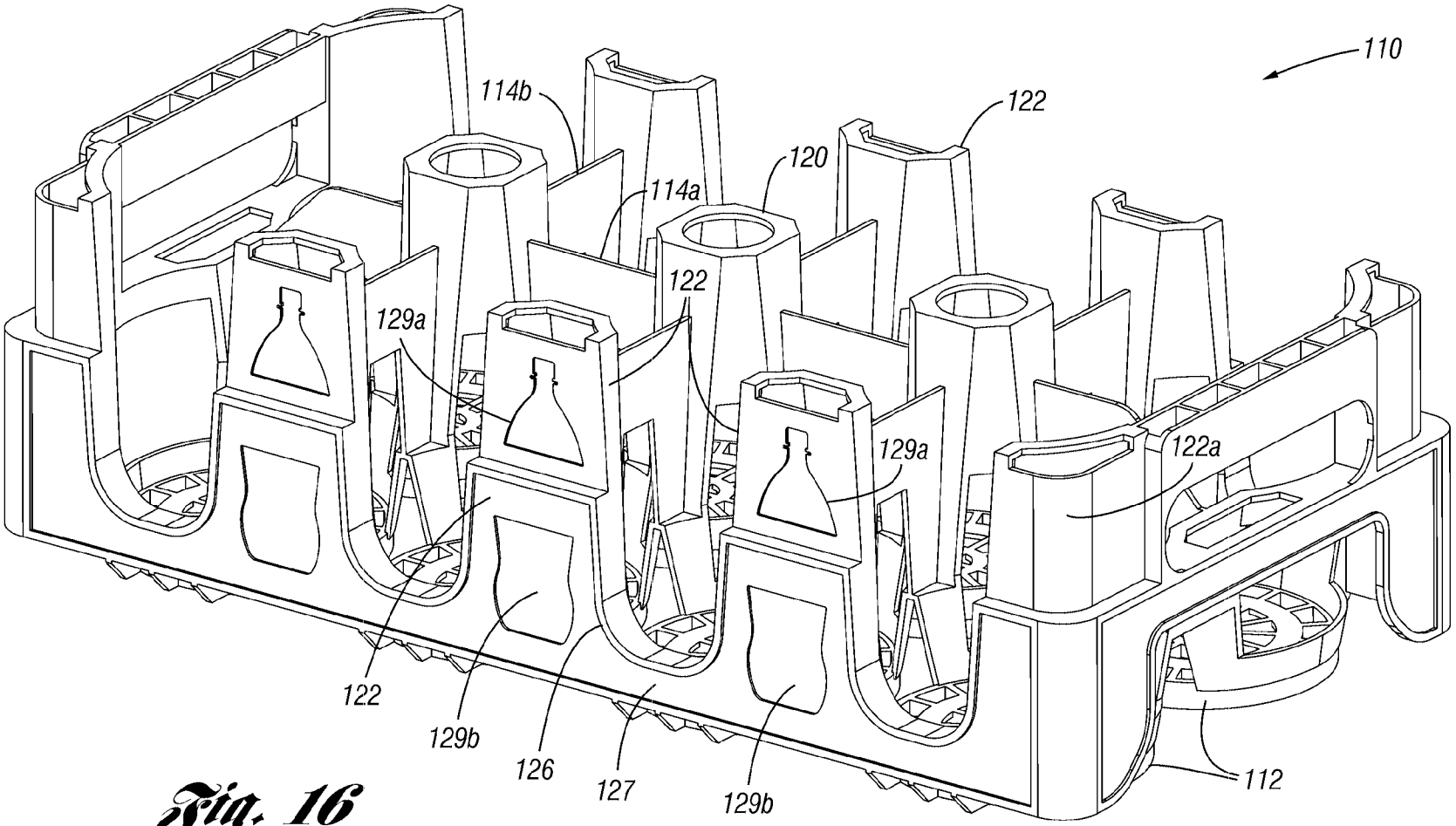
FIG. 16 is a perspective view of a tray according to a second embodiment of the present invention.
Figure 17:
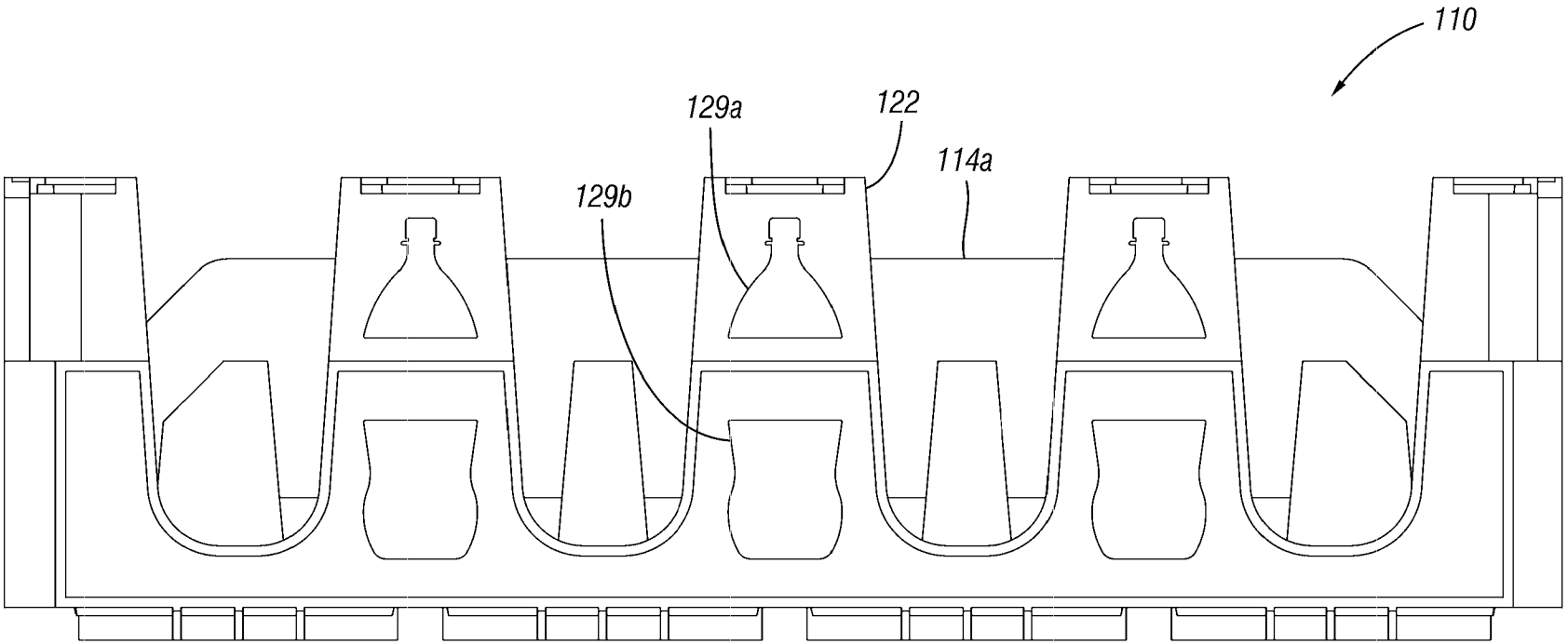
FIG. 17 is a side view of the tray of FIG. 16.

FIG. 16 is a perspective view and FIG. 17 is a side view of a tray 110 according to a second embodiment of the present invention. The tray 110 is identical to the tray 10 of FIGS. 1-15 except as specifically described below or shown in the drawings. The tray 110 includes a plurality (in this example, eight) of spaced apart base walls 112. The tray 110 includes a plurality of interior columns 120 and side columns 122, including corner columns 122*a*. Longitudinal dividers 114*a* connect the interior columns 120 to one another and lateral dividers 114*b* connect the interior columns 120 to the side columns 122. In this embodiment, the side columns 122 do not include a tapered mid-portion, in order to simplify tooling. Instead, the exterior surface of each column 122 (other than corner columns 122*a*) includes a logo molded therein. In this example, the logo includes an upper logo portion 129*a* and a lower logo portion 129*b* (collectively "logo 129"). The upper logo portion 129*a* is formed on the upper portion of the side column 122, while the lower logo portion 129*b* is formed on the lower portion of the side column 122. Together, the logo 129 is an outline or silhouette of the contoured bottles 80 (FIG. 18).

Figure 18:
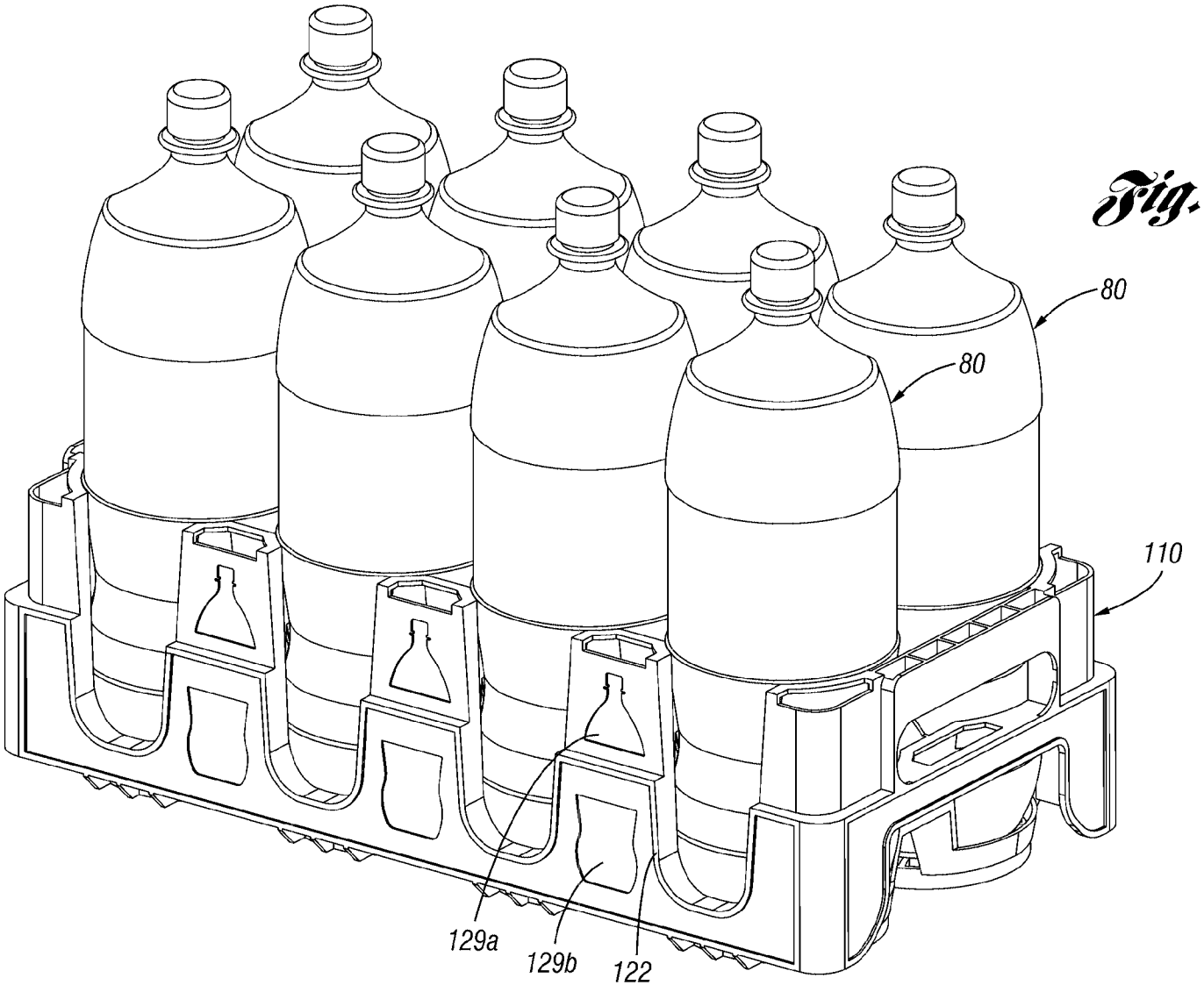
FIG. 18 illustrates the tray of FIG. 16 loaded with bottles.

FIG. 18 illustrates the tray 110 of FIG. 16 loaded with the contoured bottles 80. The bottles 80 fit in the tray 110 in the same way as the tray 10 of FIGS. 1-15. Instead of the contoured side columns 22 and window openings 25 (FIG. 1), the tray 110 includes the logos 129. Alternatively, a tray could include both the contoured side columns 22 and window openings 25 and the logos 129.

Figure 19:
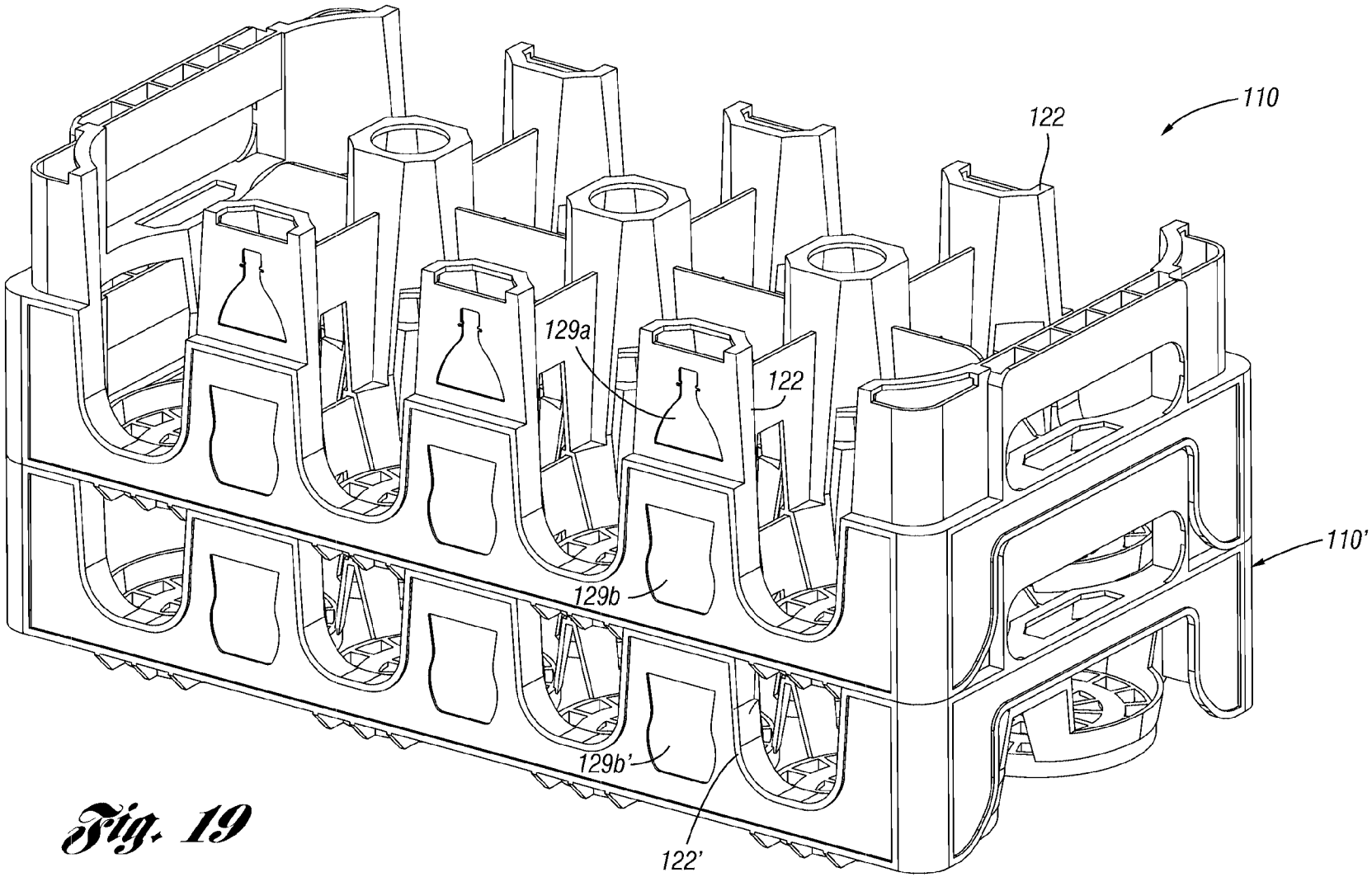
FIG. 19 is a perspective view of the tray nested on a similar tray.
Figure 20:
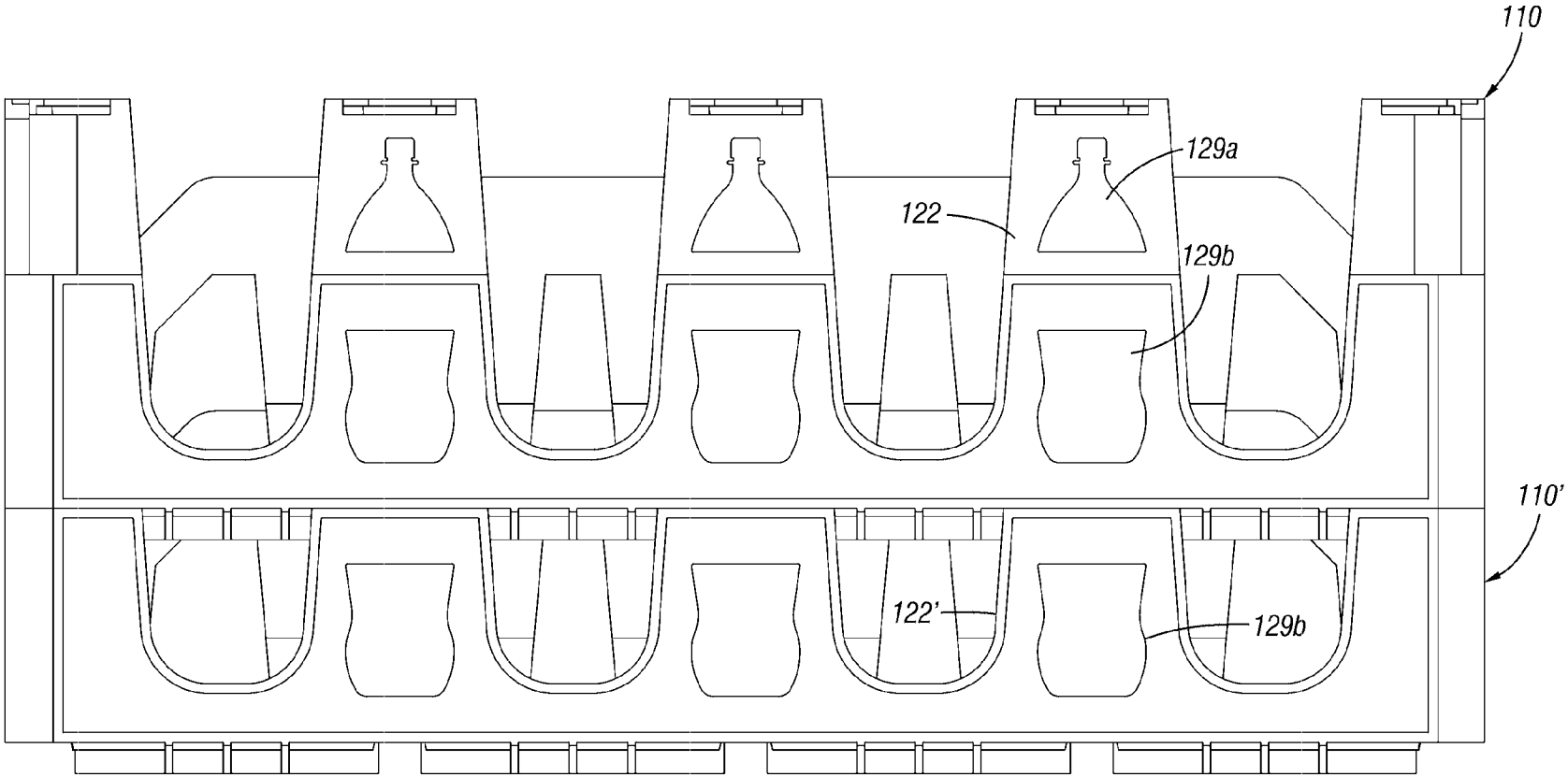
FIG. 20 is a side view of the trays of FIG. 19.

FIG. 19 is a perspective view and FIG. 20 is a side view of the tray 110 nested on a similar tray 110'. As shown, with the upper portions of the side columns 122' of the lower tray 110' received within the lower portions of the side columns 122 of the upper tray 110, only the lower logo portion 129*b*' is visible on the lower tray 110' (and any other trays stacked below the lower tray 110'). Advantageously, the lower logo portion 129*b*' includes the portion representing the contours of the bottles 80, thus still providing a recognizable logo.

In accordance with the provisions of the patent statutes and jurisprudence, exemplary configurations described above are considered to represent a preferred embodiment of the invention. However, it should be noted that the invention can be practiced otherwise than as specifically illustrated and described without departing from its spirit or scope.

What is claimed is:

1. A tray for storing and transporting bottles comprising:

a base including a plurality of spaced-apart base walls for supporting the bottles thereon;

a plurality of interior columns;

a plurality of longitudinal dividers connecting the interior columns to one another, each longitudinal divider having a lower portion including spaced apart pocket walls each connected to a different one of the plurality of spaced-apart base walls, wherein the longitudinal dividers are dimensioned and oriented to be received between the spaced apart pocket walls of an identical tray nested thereon;

a plurality of lateral dividers, each extending laterally from one of the interior columns, at least one of the longitudinal dividers or one of the lateral dividers or one of the interior columns connected to each of the base walls, a bottle-receiving pocket defined on each of the base walls, the bottle receiving pockets separated from one another by the longitudinal dividers and the lateral dividers; and a plurality of side columns, each connected to one of the interior columns by one of the lateral dividers, the side columns spaced apart to define upwardly-open windows aligned with each of the bottle-receiving pockets.

2. The tray of claim 1 wherein the pocket walls are spaced apart curved walls defining the bottle-receiving pockets.

3. The tray of claim 1 further including a lower wall portion extending between adjacent side columns, one of the plurality of windows defined above the lower wall portion.

4. The tray of claim 3 wherein an upper edge of the lower wall portion is shorter than the pocket walls.

5. The tray of claim 3 wherein the longitudinal dividers extend upward above the base walls of the identical tray more than the lower wall portion of the identical tray when the identical tray is nested on the tray.

6. The tray of claim 1 wherein the windows have a narrower portion above a wider portion.

7. The tray of claim 6 wherein the side columns have tapered mid-portions.

8. The tray of claim 1 wherein at least one of the side columns is a corner column.

9. The tray of claim 1 wherein two of the side columns are corner columns, a handle portion extending between the corner columns.

10. The tray of claim 1 wherein the lateral dividers are received between the spaced apart base walls of the identical tray when the identical tray is nested thereon.

11. The tray of claim 1 further including a logo molded on an outer surface of at least a first side column of the plurality of side columns.

12. The tray of claim 11 wherein the first side column includes an upper portion and a lower portion, the upper portion of the first side column received in the lower portion of the identical tray when the identical tray is nested on the tray, and wherein the logo includes an upper logo portion molded onto the upper portion of the first side column and a lower logo portion molded onto the lower portion of the first side column.

13. The tray of claim 11 wherein the logo is in the shape of a bottle.

14. A tray for storing and transporting bottles comprising:

a base including a plurality of spaced-apart base walls for supporting the bottles thereon;

a plurality of interior columns;

a plurality of longitudinal dividers connecting the interior columns to one another;

a plurality of lateral dividers, each extending laterally from one of the interior columns, at least one of the longitudinal dividers or one of the lateral dividers or one of the interior columns connected to each of the base walls, a bottle-receiving pocket defined on each of the base walls, the bottle receiving pockets separated from one another by the longitudinal dividers and the lateral dividers; and a plurality of side columns, each connected to one of the interior columns by one of the lateral dividers, at least a first side column of the side columns having a tapered mid-portion below a wider portion of the first side column, the side columns spaced apart to define upwardly-open windows aligned with each of the bottle-receiving pockets, a lower wall portion extending between adjacent side columns.

15. The tray of claim 14 wherein at least one of the longitudinal dividers or the lateral dividers has a lower end including spaced apart pocket walls each connected to a different one of the plurality of spaced-apart base walls.

16. The tray of claim 15 wherein an upper edge of the lower wall portion is shorter than the pocket walls.

17. The tray of claim 16 wherein at least one of the plurality of windows has a narrower portion above a wider portion, wherein the at least one of the plurality of windows is adjacent the at least one of the side columns.

18. The tray of claim 17 wherein the first side column has a lateral edge that is contoured to define the wider portion and the narrower portion of the adjacent window.

19. The tray of claim 18 further including a rib protruding outward from the first side column in a direction away from an interior of the tray, the rib adjacent the lateral edge of the first side column.

20. The tray of claim 14 further including a plurality of ribs extending from each of the base walls respectively to adjacent ones of the lower wall portions.

21. A tray for storing and transporting bottles comprising:

a base including a plurality of spaced apart base walls for supporting the bottles thereon;

a plurality of interior columns;

a plurality of longitudinal dividers connecting the interior columns to one another, each longitudinal divider having an upper portion having a single-wall thickness header portion, each longitudinal divider further including a lower portion including spaced apart pocket walls each connected to a different one of the plurality of spaced-apart base walls wherein the longitudinal dividers are dimensioned and oriented to be received between the spaced apart pocket walls of an identical tray nested thereon;

a plurality of lateral dividers, each extending laterally from one of the interior columns, a bottle-receiving pocket defined on each of the base walls, the bottle receiving pockets separated from one another by the longitudinal dividers and the lateral dividers, wherein the longitudinal dividers, the lateral dividers and columns define eight bottle receiving pockets which are equally-spaced longitudinally and laterally; and a plurality of side columns, each connected to one of the interior columns by one of the lateral dividers, the side columns including an upper portion having a smaller dimension than a lower portion of the side columns, the upper portions of the side columns received in the lower portions of the side columns of the identical tray when the identical tray is nested on the tray, the lower portions defining upwardly open windows between adjacent lower portions.

22. The tray of claim 21 wherein the pocket walls are spaced apart curved walls defining the bottle-receiving pockets, wherein the pocket walls are curved opening away from one another.

23. The tray of claim 21 further including a lower wall portion extending between adjacent side columns, one of the plurality of windows defined above the lower wall portion.

24. The tray of claim 21 wherein the longitudinal dividers and the lateral dividers are received between the spaced apart base walls of the identical tray when the identical tray is nested thereon.

25. A tray for storing and transporting bottles comprising:

a base;

a plurality of interior columns extending upward from the base;

a plurality of longitudinal dividers connecting the interior columns to one another;

a plurality of lateral dividers, each extending laterally from one of the interior columns, a plurality of bottle receiving pockets defined by the longitudinal dividers and the lateral dividers; and a plurality of side columns, each connected to one of the interior columns by one of the lateral dividers, at least one of the side columns including a logo molded into an exterior surface, wherein the at least one side column includes an upper portion and a lower portion, the upper portion of the side column received in the lower portion of an identical tray when the identical tray is nested on the tray, and wherein the logo includes an upper logo portion molded onto the upper portion of the side column and a lower logo portion molded onto the lower portion of the side column, such that the upper logo portion is received inside the lower portion of the side column of the identical tray nested on the tray.

26. The tray of claim 25 wherein the logo is in the shape of a bottle.

27. The tray of claim 14 wherein at least one of the plurality of windows is adjacent the first side column and has a narrower portion above a wider portion.

* * * * *